US012320234B2

(12) United States Patent
Gonzalez

(10) Patent No.: US 12,320,234 B2
(45) Date of Patent: Jun. 3, 2025

(54) WIRELINE RETRIEVABLE FLAPPER AND SEAT

(71) Applicant: Halliburton Energy Services, Inc., Houston, TX (US)

(72) Inventor: Merced Gonzalez, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 51 days.

(21) Appl. No.: 17/965,392

(22) Filed: Oct. 13, 2022

(65) Prior Publication Data

US 2024/0125205 A1 Apr. 18, 2024

(51) Int. Cl.
*E21B 34/10* (2006.01)
*E21B 34/14* (2006.01)

(52) U.S. Cl.
CPC ..... *E21B 34/105* (2013.01); *E21B 34/14* (2013.01); *E21B 2200/05* (2020.05)

(58) Field of Classification Search
CPC ..... E21B 34/105; E21B 34/14; E21B 2200/05
USPC ..... 166/322
See application file for complete search history.

(56) References Cited

U.S. PATENT DOCUMENTS 4,119,146 A 10/1978 Taylor
4,664,195 A * 5/1987 Deaton ..... E21B 34/08 166/324
5,226,483 A 7/1993 Williamson, Jr.
2007/0056747 A1 3/2007 Jacob
2008/0230231 A1 9/2008 Bolding et al.
2010/0025045 A1 2/2010 Lake et al.
2010/0096145 A1 4/2010 Bolding et al.
2013/0032355 A1* 2/2013 Scott ..... E21B 34/066 166/373
2013/0032356 A1 2/2013 Scott et al.
2018/0355698 A1* 12/2018 Williamson ..... E21B 34/16
2020/0392811 A1 12/2020 Vick, Jr. et al.
2021/0025261 A1* 1/2021 Ostrovskiy ..... E21B 23/02

FOREIGN PATENT DOCUMENTS

WO 2014022266 A1 2/2014
WO 2020041056 A1 2/2020

* cited by examiner

*Primary Examiner* — Matthew Troutman
*Assistant Examiner* — Patrick F Lambe
(74) *Attorney, Agent, or Firm* — Scott Richardson; Parker Justiss, P.C.

(57) ABSTRACT

Provided is a retrievable safety valve insert, a safety valve, a well system, and a method. The retrievable safety valve insert, in one aspect, includes an outer housing including an outer housing central bore extending axially therethrough, the outer housing central bore operable to convey subsurface production fluids there through. The insert, according to this aspect, may further include a lock mandrel having a lock mandrel profile extending radially outward from the outer housing, the lock mandrel profile movable between a radially retracted state and a radially expanded state configured to engage with an end sub profile of an end sub. The insert, according to this aspect, may further include a safety valve insert closure mechanism coupled to the outer housing proximate a downhole end of the outer housing central bore, the safety valve insert closure mechanism movable between an outer housing closed state and an outer housing open state.

30 Claims, 27 Drawing Sheets

WIRELINE RETRIEVABLE FLAPPER AND SEAT

BACKGROUND

Safety valves (e.g., including subsurface safety valves (SSSVs)) are well known in the oil and gas industry and provide one of many failsafe mechanisms to prevent the uncontrolled release of subsurface production fluids, should a wellbore system experience a loss in containment. Typically, safety valves comprise a portion of a tubing string, the entirety of the safety valve being set in place during completion of a wellbore. Although a number of design variations are possible for safety valves, the vast majority are flapper-type valves that open and close in response to longitudinal movement of a flow tube.

BRIEF DESCRIPTION

Reference is now made to the following descriptions taken in conjunction with the accompanying drawings, in which.

DETAILED DESCRIPTION

Figure 1:
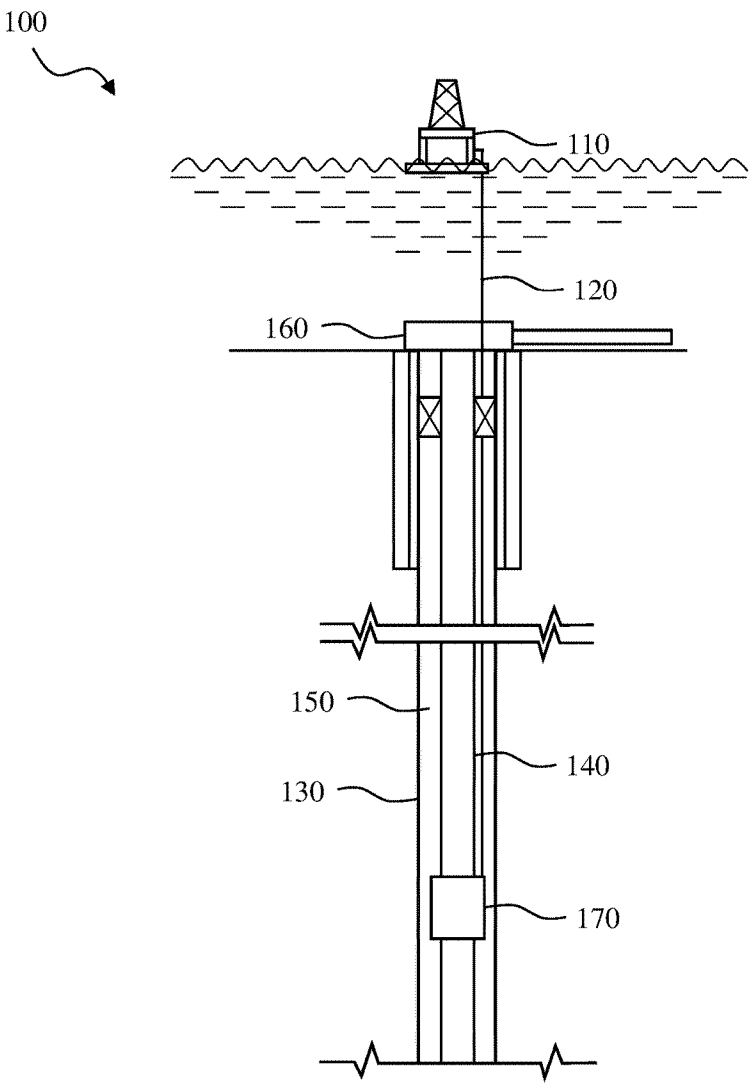
FIG. 1 illustrates a well system designed, manufactured and/or operated according to one or more embodiments of the disclosure.

In the drawings and descriptions that follow, like parts are typically marked throughout the specification and drawings with the same reference numerals, respectively. The drawn figures are not necessarily, but may be, to scale. Certain features of the disclosure may be shown exaggerated in scale or in somewhat schematic form and some details of certain elements may not be shown in the interest of clarity and conciseness. The present disclosure may be implemented in embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results. Moreover, all statements herein reciting principles and aspects of the disclosure, as well as specific examples thereof, are intended to encompass equivalents thereof. Additionally, the term, "or," as used herein, refers to a non-exclusive or, unless otherwise indicated.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "uphole," "upstream," or other like terms shall be construed as generally away from the bottom, terminal end of a well, regardless of the wellbore orientation; likewise, use of the terms "down," "lower," "downward," "downhole," "downstream," or other like terms shall be construed as generally toward the bottom, terminal end of a well, regardless of the wellbore orientation. Use of any one or more of the foregoing terms shall not be construed as denoting positions along a perfectly vertical or horizontal axis. Unless otherwise specified, use of the term "subterranean formation" shall be construed as encompassing both areas below exposed earth and areas below earth covered by water, such as ocean or fresh water.

The present disclosure has acknowledged that offshore wells are being drilled at ever increasing water depths and in environmentally sensitive waters, and thus safety valves (e.g., including subsurface safety valves (SSSVs)) are necessary. The present disclosure has further acknowledged that safety valves have inherent problems. For instance, the present disclosure has recognized that the operational lifespan of traditional safety valve is less than optimal, whether they completely quit working or alternatively begin to leak. In such situations where the safety valves completely stop working or alternatively begin to leak, the tubing string that the safety valves are coupled to must be pulled out of hole, coupled to a new working safety valve, and then returned within the wellbore, which is an expensive and time consuming process. Alternatively, a secondary wireline retrievable safety valve may be insert within the wellbore, but they tend to have their own problems.

Based, at least in part, on the foregoing acknowledgments and recognitions, the present disclosure has developed a retrievable safety valve insert (e.g., tubing string independent retrievable safety valve insert). The retrievable safety valve insert, in at least one embodiment, may be run in hole in two or more steps. For example, an outer housing, lock mandrel and safety valve insert of the retrievable safety valve insert may be first run in hole. Thereafter, a secondary opening prong may be run in hole, and for example coupled with a bore flow management actuator of the failed safety valve. In at least one embodiment, when coupled with the bore flow management actuator of the failed safety valve, the secondary opening prong is configured to move with the bore flow management actuator to: 1) hold the valve body closure mechanism of the failed safety valve in the valve body open state and allow the safety valve insert closure mechanism of the retrievable safety valve insert to remain in the outer housing closed state when the bore flow management actuator is in an uphole state; or 2) hold the valve body closure mechanism in the valve body open state and hold the safety valve insert closure mechanism in the outer housing open state when the bore flow management actuator is in a downhole state. The process of inserting the retrievable safety valve insert within the wellbore is a much less expensive and much less time consuming process (e.g., can eliminate the need for a workover unit) than is currently necessary when pulling the tubing string, as discussed above.

Safety valves according to the disclosure may include hydraulic and/or electric actuation. For example, in at least one embodiment, a hydraulic actuator is coupled to the bore flow management actuator to move the bore flow management actuator, and thus the secondary opening prong, from the uphole state to the downhole state. In at least one other embodiment, an electric actuator is coupled to the bore flow management actuator to move the bore flow management actuator, and thus the secondary opening prong, from the uphole state to the downhole state.

A safety valve according to the disclosure may also have increased failsafe ability as compared to other safety valves. Failsafe may be defined as a condition in which the safety valve or associated control system may be damaged and the safety valve (e.g., including the retrievable safety valve insert) retains the ability to close. In some examples, the safety valve may fail in a closed position (e.g., closed state), thus ensuring that wellbore fluids and pressure are contained. In another example, the safety valve (e.g., including the retrievable safety valve insert) may fail while in an open position (e.g., flow state), but closes automatically (e.g., using one or more springs) when a hydraulic and/or electrical connection to the surface is damaged or severed without any additional external input.

FIG. 1 illustrates a well system 100 designed, manufactured and/or operated according to one or more embodiments of the disclosure. The well system 100, in at least one embodiment, includes an offshore platform 110 connected to a safety valve 170 via a control line 120 (e.g., hydraulic control line, electrical control line, etc.). An annulus 150 may be defined between walls of a wellbore 130 and a conduit 140. A wellhead 160 may provide a means to hand off and seal conduit 140 against the wellbore 130 and provide a profile to latch a subsea blowout preventer to. Conduit 140 may be coupled to the wellhead 160. Conduit 140 may be any conduit such as a casing, liner, production tubing, or other oilfield tubulars disposed in a wellbore.

The safety valve 170, or at least a portion thereof, may be interconnected in conduit 140 (e.g., in line with conduit) and positioned in the wellbore 130. Although the well system 100 is depicted in FIG. 1 as an offshore well system, one of ordinary skill should be able to adopt the teachings herein to any type of well, including onshore or offshore. The control line 120 may extend into the wellbore 130 and may be connected to the safety valve 170. The control line 120 may provide actuation power to the safety valve 170. As will be described in further detail below, power may be provided to the safety valve 170 to actuate or de-actuate the safety valve 170. Actuation may comprise opening the safety valve 170 to provide a flow path for subsurface production fluids to enter conduit 140, and de-actuation may comprise closing the safety valve 170 to close a flow path for subsurface production fluids to enter conduit 140.

The safety valve 170, in at least one embodiment, may include a retrievable safety valve insert. The retrievable safety valve insert, in at least one embodiment, may include an outer housing including an outer housing central bore extending axially through the outer housing, the outer housing central bore operable to convey subsurface production fluids there through, and a lock mandrel having a lock mandrel profile extending radially outward from the outer housing, the lock mandrel profile movable between a radially retracted state and a radially expanded state configured to engage with an end sub profile of an end sub. The retrievable safety valve insert may further include a safety valve insert closure mechanism coupled to the outer housing proximate a downhole end of the outer housing central bore, the safety valve insert closure mechanism movable between an outer housing closed state and an outer housing open state. In at least one embodiment, the safety valve 170 further includes a secondary opening prong coupled to a bore flow management actuator of the safety valve 170. Accordingly, the safety valve 170 may employ movement of the bore flow management actuator to slide the secondary opening prong to open and/or close the safety valve insert closure mechanism of the retrievable safety valve insert. While the embodiment of FIG. 1 illustrates only a single safety valve 170, other embodiments exist wherein multiple safety valve 170 according to the disclosure are used.

Figure 2:
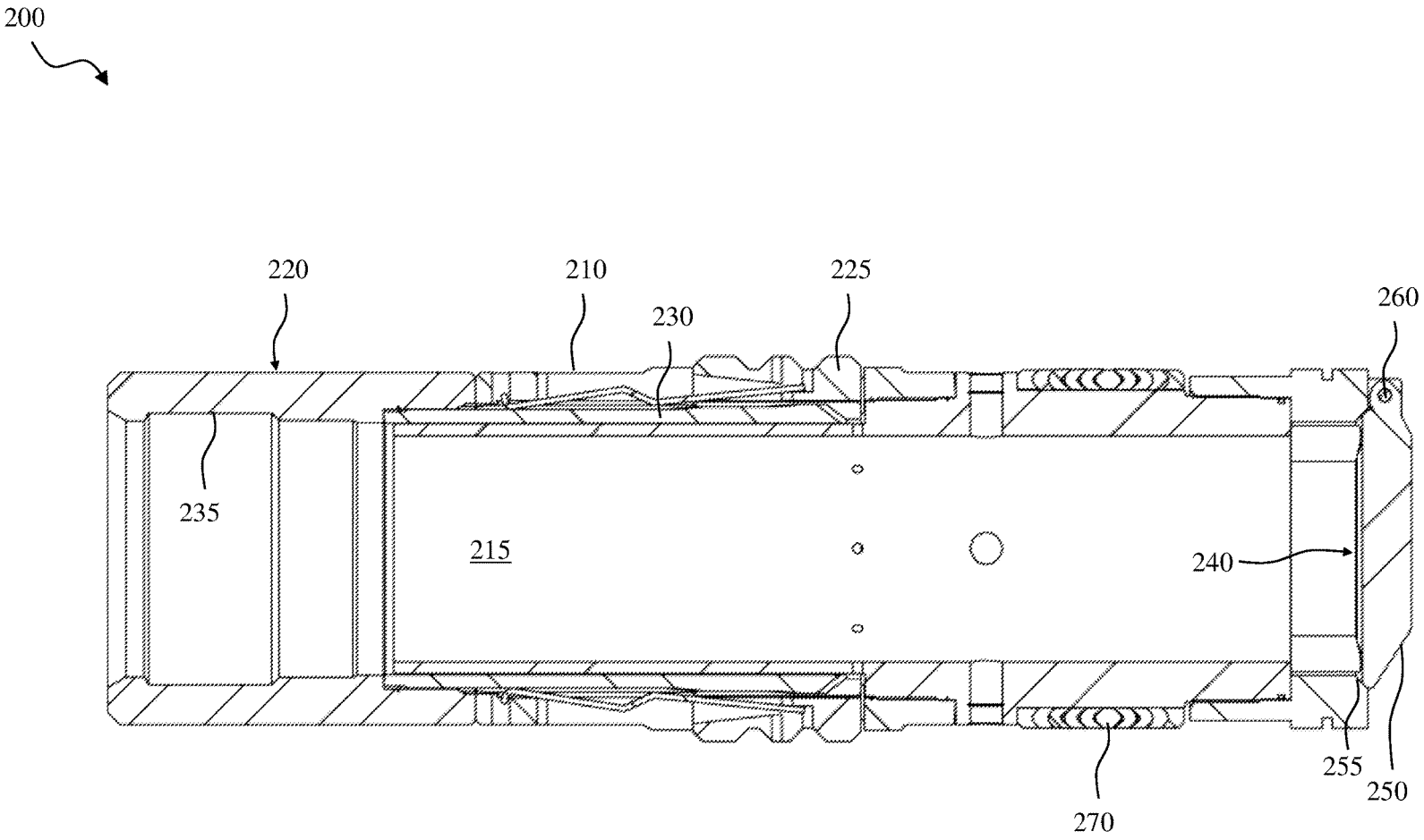
FIG. 2 illustrates one embodiment of a retrievable safety valve insert, as might form part of a safety valve (e.g., safety valve of FIG. 1), designed and manufactured according to the present disclosure.

Turning now to FIG. 2, illustrated is one embodiment of a retrievable safety valve insert 200, as might form part of a safety valve (e.g., safety valve 170 of FIG. 1), designed and manufactured according to the present disclosure. The retrievable safety valve insert 200, in at least one embodiment, may engage with an end sub profile of an end sub coupled to a downhole end of the safety valve. The retrievable safety valve insert 200, in at least one embodiment, includes an outer housing 210 including an outer housing central bore 215 extending axially through the outer housing 210. The outer housing central bore 215, in one or more embodiments, is operable to convey subsurface production fluids there through.

The retrievable safety valve insert 200 may further include a lock mandrel 220. In at least one embodiment, the lock mandrel 220 has a lock mandrel profile 225 extending radially outward from the outer housing 210, the lock mandrel profile 225 movable between a radially retracted state (e.g., not shown) and a radially expanded state (e.g., shown) configured to engage with the end sub profile of the end sub. In at least one embodiment, the lock mandrel 220 includes a sliding wedge 230, the sliding wedge 230 operable to engage the lock mandrel profile 225 to move the lock mandrel profile 225 from the radially retracted state to the radially expanded state. The lock mandrel 220, in at least this one embodiment, further includes a deployment profile 235 located along an inner surface of the lock mandrel 220, the deployment profile 235 operable to deploy the retrievable safety valve insert 200 within the end sub, as well as move the lock mandrel profile 225 from the radially retracted state to the radially expanded state to engage the end sub profile of the end sub.

The retrievable safety valve insert 200, in the illustrated embodiment, further includes a safety valve insert closure mechanism 240 coupled to the outer housing 210 proximate a downhole end of the outer housing central bore 215. The safety valve insert closure mechanism 240, in the illustrated embodiment, is movable between an outer housing closed state (e.g., as shown) and an outer housing open state (e.g., not shown). The safety valve insert closure mechanism 240, in the illustrated embodiment of FIG. 2, is a safety valve insert flapper valve 250 configured to engage with a safety valve insert flapper seat 255 positioned in the outer housing. The safety valve insert closure mechanism 240, in the illustrated embodiment, further includes a bias spring 260 configured to bias the safety valve insert closure mechanism 240 toward the outer housing closed state.

In the illustrated embodiment of FIG. 2, the retrievable safety valve insert 200 additionally includes one or more seals 270 positioned about the outer housing 210 between the lock mandrel profile 225 and the safety valve insert closure mechanism 240. In the illustrated embodiment, the one or more seals 270 are one or more chevron seals. Nevertheless, other embodiments exist that may include any other seal currently known or later found in the art.

Figure 3:
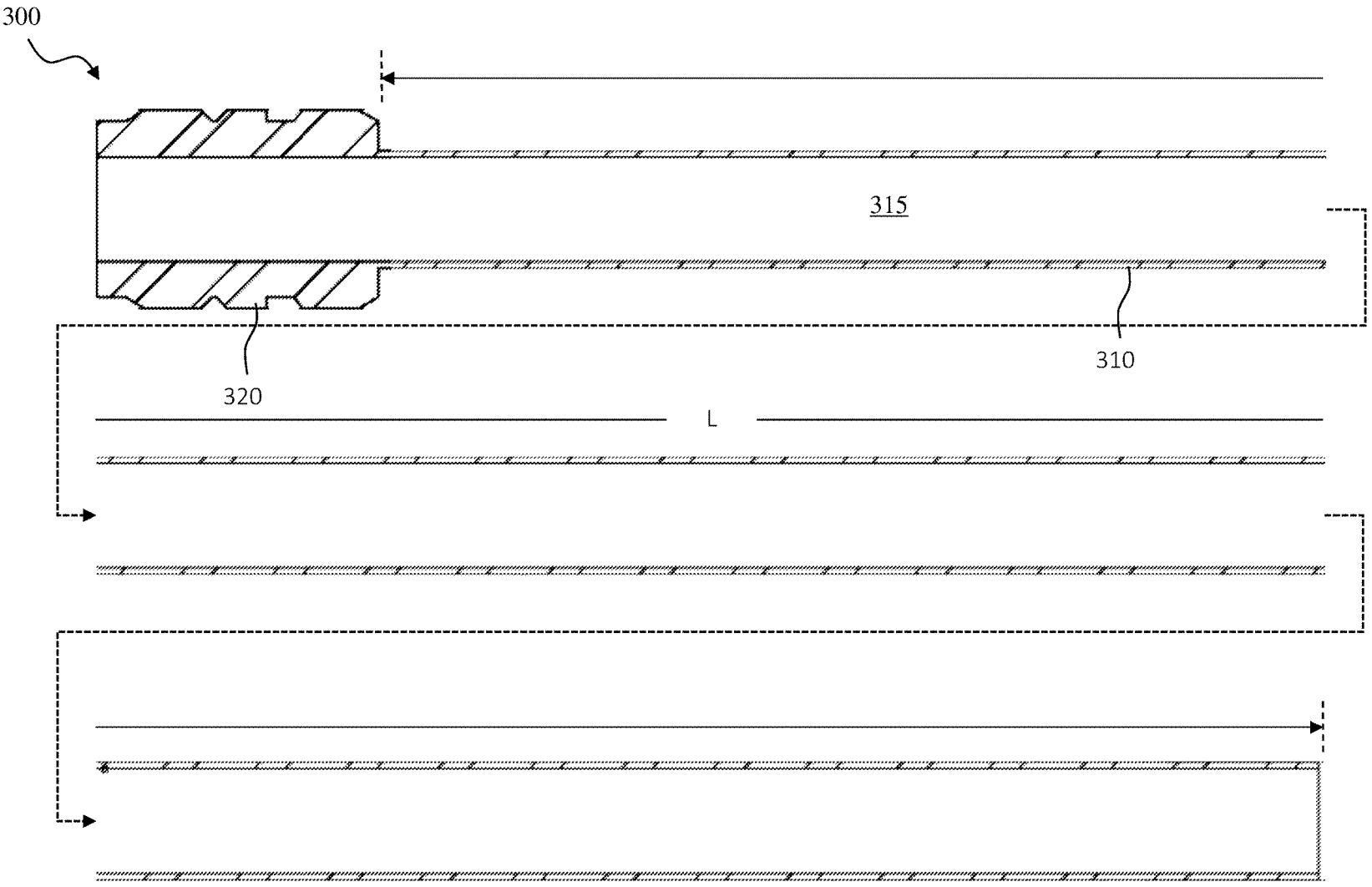
FIG. 3 illustrates a secondary opening prong designed and manufactured according to one or more embodiments of the disclosure.

Turning to FIG. 3, illustrated is a secondary opening prong 300 designed and manufactured according to one or more embodiments of the disclosure. The secondary opening prong 300, in one or more embodiments, includes a tubular 310 having a prong central bore 315. The tubular 310, in one or more embodiments, includes a length (L). In accordance with one embodiment, the length (L) should be long enough to allow the secondary opening prong 300 to prop open the valve body closure mechanism of the safety valve, as well as prop open the safety valve insert closure mechanism of the retrievable safety valve insert as the bore flow management actuator of the safety valve moves. Thus, in at least one embodiment, the length (L) is at least 0.5 m. In at least one other embodiment, the length (L) is at least 1.5 m, if not at least 2 m.

The secondary opening prong 300, in accordance with at least one embodiment, further includes a secondary opening prong profile 320. The secondary opening prong profile 320, in one or more embodiments, is configured to engage with a related bore flow management actuator profile (e.g., not shown) in a bore flow management actuator of a safety valve. When the secondary opening prong profile 320 is engaged with the bore flow management actuator profile, any movement of the bore flow management actuator moves the secondary opening prong 300, as will be further discussed below.

In at least one embodiment, the secondary opening prong 300 comprises metal. In yet another embodiment, the secondary opening prong 300 comprises any other materials suitable for downhole use, including various plastics and/or polymers.

Figure 4A:
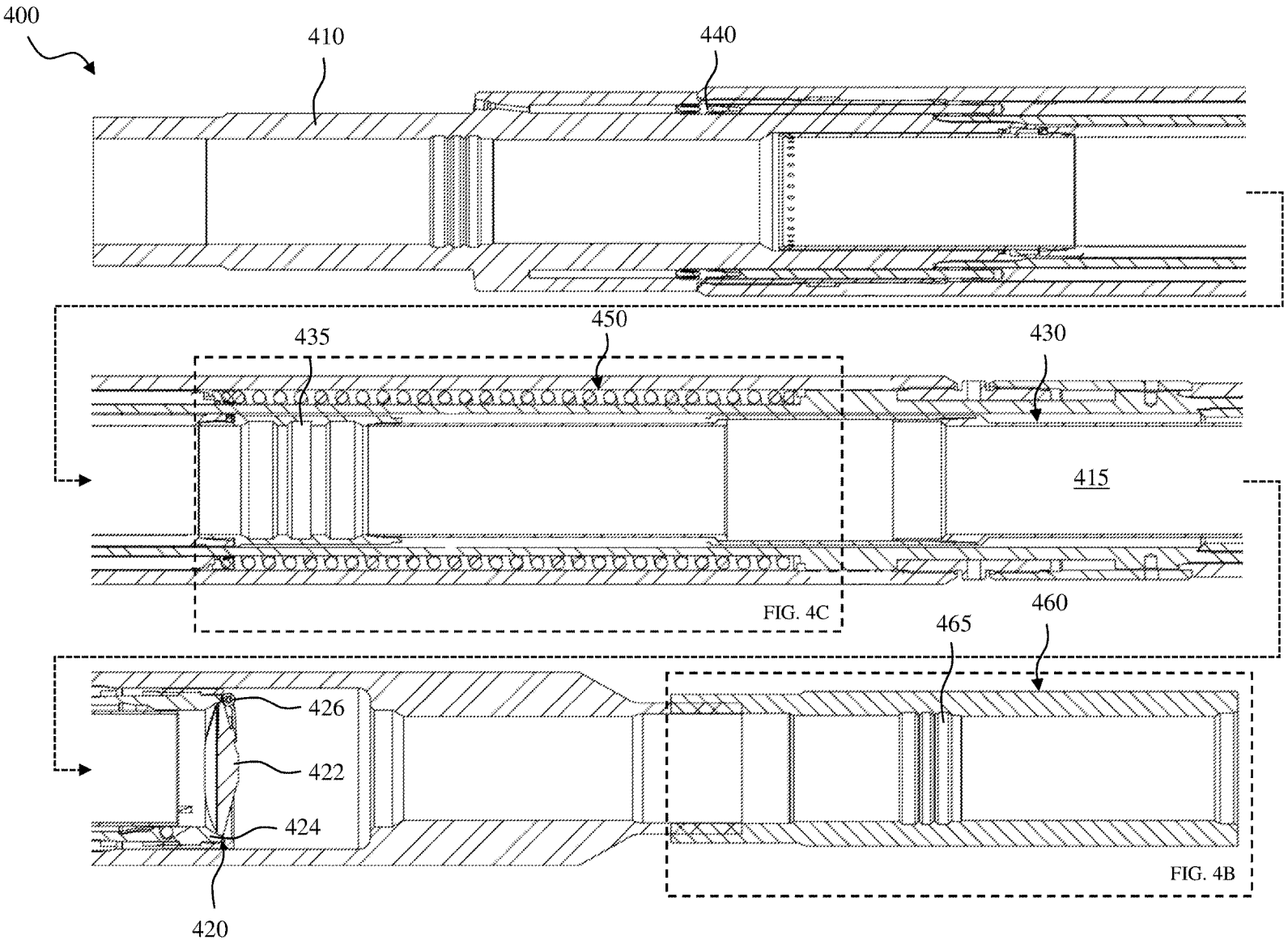
FIGS. 4A through 11C illustrate various different views of a safety valve designed, manufactured, operated, and/or modified according to one or more embodiments of the disclosure.

Turning to FIGS. 4A through 11C, illustrated are various different views of a safety valve 400 designed, manufactured, operated, and/or modified according to one or more embodiments of the disclosure. Each of FIGS. 4 through 11 illustrate different views of the safety valve 400 at different stages of use. For example, FIGS. 4A through 4C illustrate the safety valve 400 as it might be initially operated, while FIGS. 5A through 11C illustrate various different views of the safety valve 400 after a retrievable safety valve insert and/or secondary opening prong is included therein, as well as operated therewith. As the retrievable safety valve insert and/or secondary opening prong of FIGS. 4A through 11C are similar to the retrievable safety valve insert 200 and/or secondary opening prong 300 of FIGS. 2 and 3, like reference numerals will be used to indicate similar, if not identical, features.

Figure 4B:
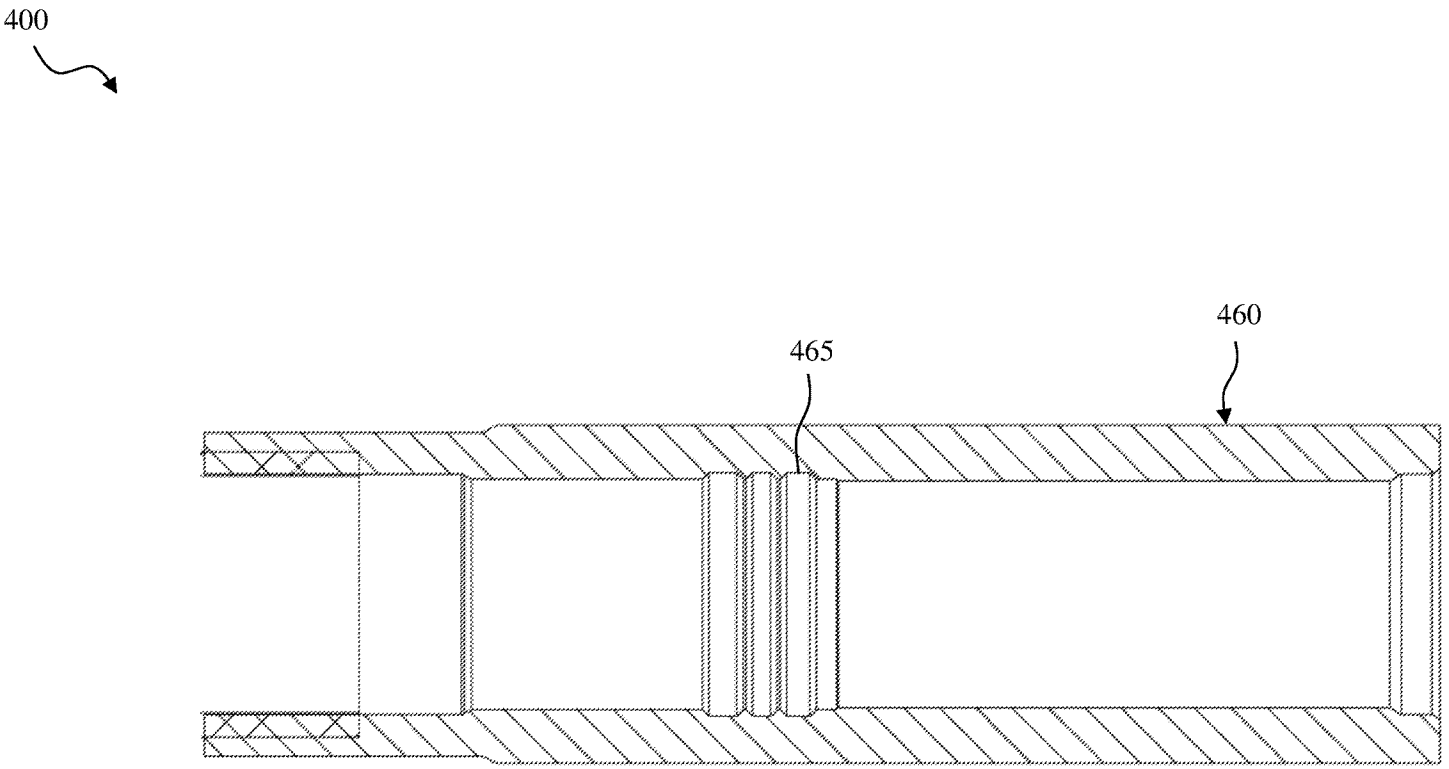
Figure 4C:
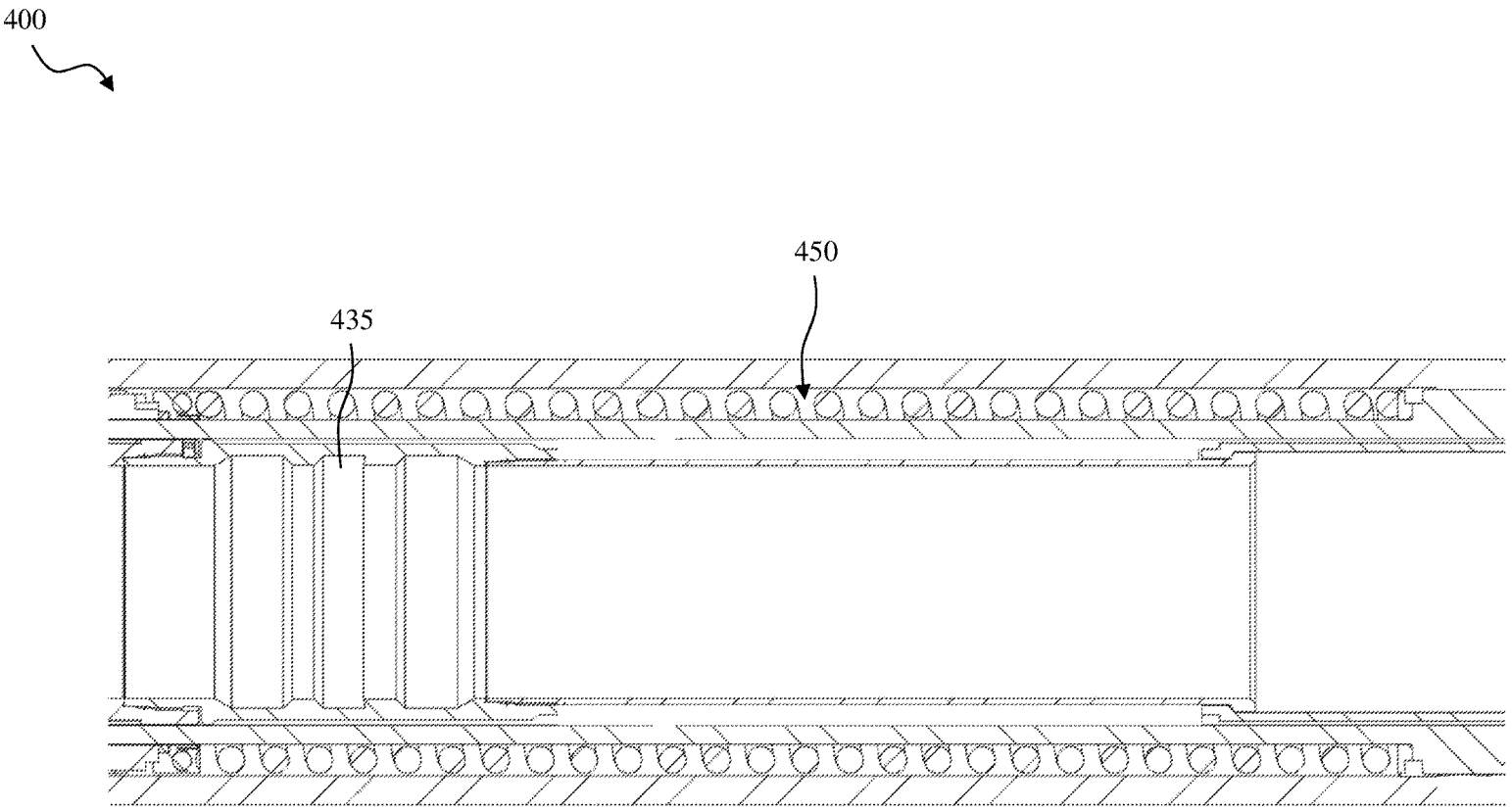

With initial reference to FIGS. 4A through 4C, the safety valve 400 includes a valve body 410 defining a valve body central bore 415 extending through the valve body 410. In this embodiment, the valve body central bore 410 is operable to convey subsurface production fluids there through.

The safety valve 400, in one or mor embodiments, further includes a valve body closure mechanism 420 coupled to the valve body 410 proximate a downhole end of the valve body central bore 415. The valve body closure mechanism 420, in accordance with one embodiment, is configured to move between a valve body closed state (e.g., as shown) and a valve body open state (e.g., not shown). In at least one embodiment, the valve body closure mechanism 420 includes a safety valve flapper valve 422 that engages with a safety valve flapper seat 424. The valve body closure mechanism 420, in one or more embodiments, may additionally include a bias spring 426, the bias spring 426 configured to bias the valve body closure mechanism 420 towards the valve body closed state.

The safety valve 400, in one or more embodiments, may further include a bore flow management actuator 430 disposed in the valve body central bore 415, the bore flow management actuator 430 configured to slide to move the valve body closure mechanism 420 between the valve body closed state (e.g., as shown) and the valve body open state (e.g., not shown). In the embodiment of FIGS. 4A through 4C, the bore flow management actuator 430 is located in an uphole state, and thus the valve body closure mechanism 420 is in the valve body closed state. Were the bore flow management actuator 430 to be in a downhole state, it would typically be propping the valve body closure mechanism 420 in the valve body open state.

In at least one embodiment, the bore flow management actuator 430 includes a bore flow management actuator profile 435 located along an inner surface thereof. As will be discussed further below, the bore flow management actuator profile 435 may be used to engage with a secondary opening prong profile of a secondary opening prong. Further to the embodiment of FIGS. 4A through 4C, the bore flow management actuator 430 is coupled to an actuator 440, whether that actuator 440 is a hydraulic actuator, an electric actuator, or another known type of actuator. The actuator 440, in this embodiment, is configured to move the bore flow management actuator 430 between its uphole state and its downhole state.

The safety valve 400, in one or more embodiments, may further include one or more springs 450 coupled to the bore flow management actuator 430, the one or more springs 450 configured to return the bore flow management actuator 430 to the uphole state when the actuator 440 loses power, or the power is cut to the actuator 440. Nevertheless, other embodiments exist wherein only a single spring is employed.

The safety valve 400, in the illustrated embodiment, additionally includes an end sub 460 coupled to a downhole end of the valve body 410. In one or more embodiments, the end sub 460 includes an end sub profile 465 along an inner surface thereof. As will be discussed in greater detail below, the end sub profile 465 is operable to engage with a related lock mandrel profile of the retrievable safety valve insert that may be included therein.

Figure 5A:
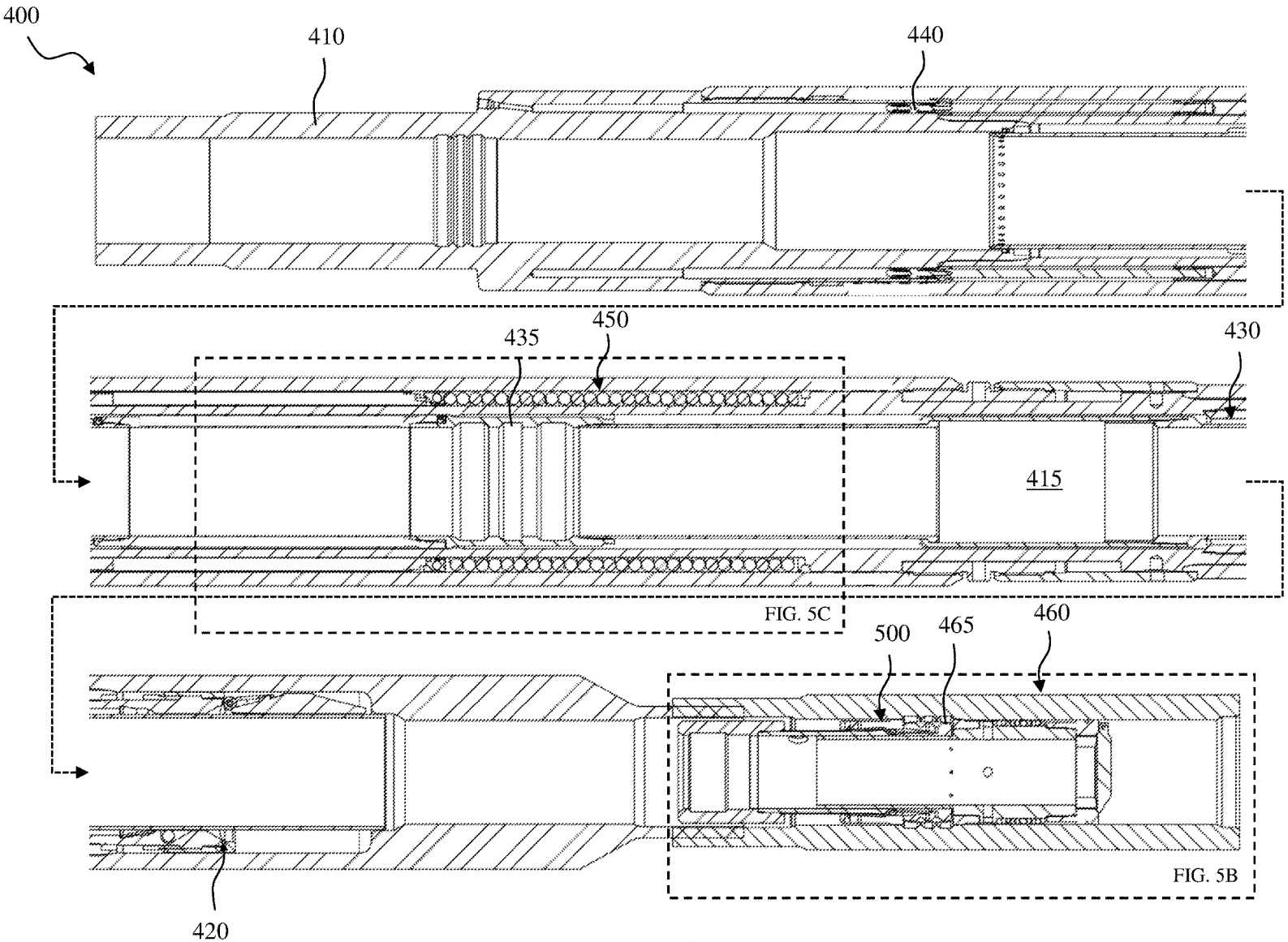
Figure 5B:
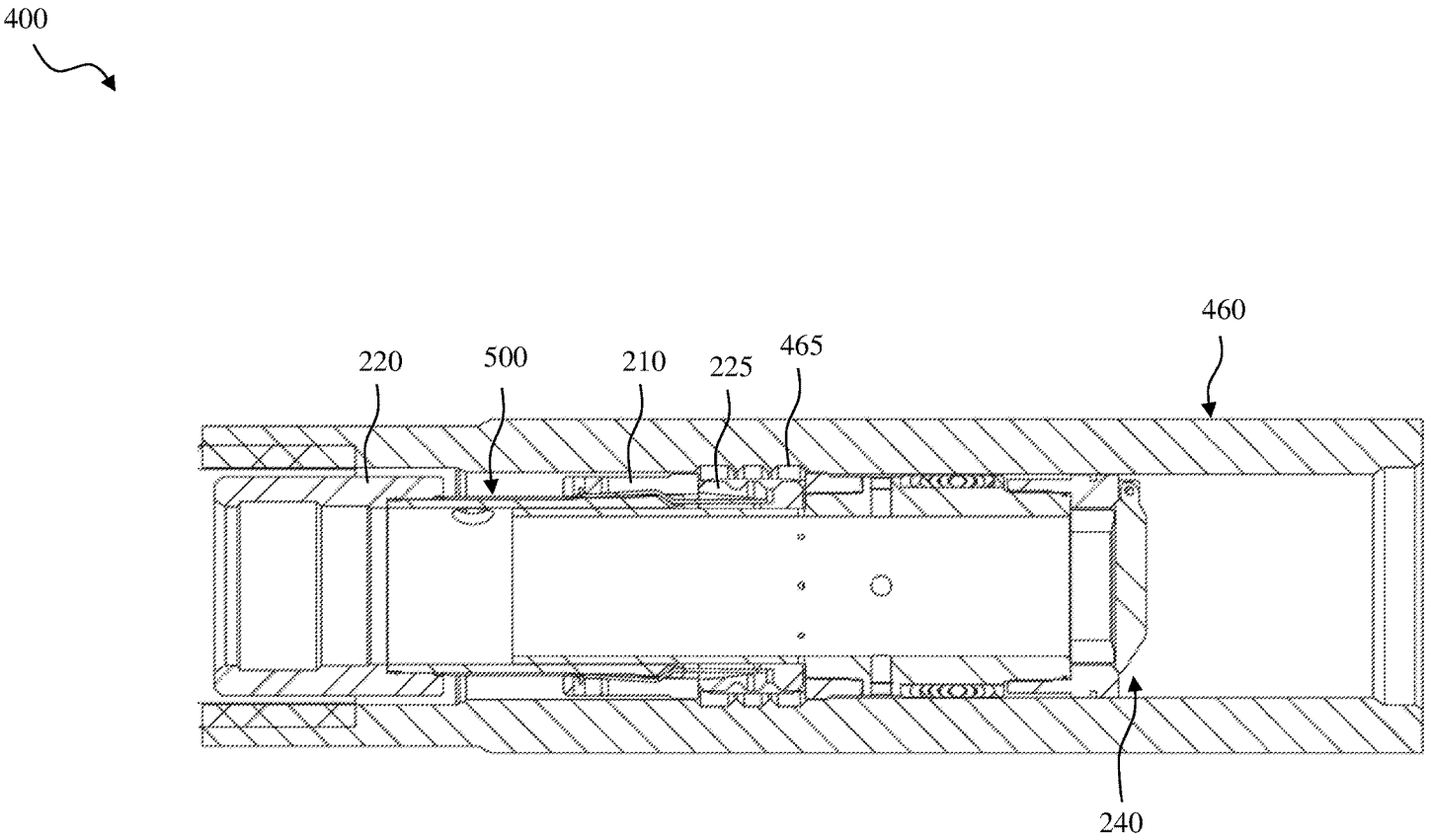
Figure 5C:
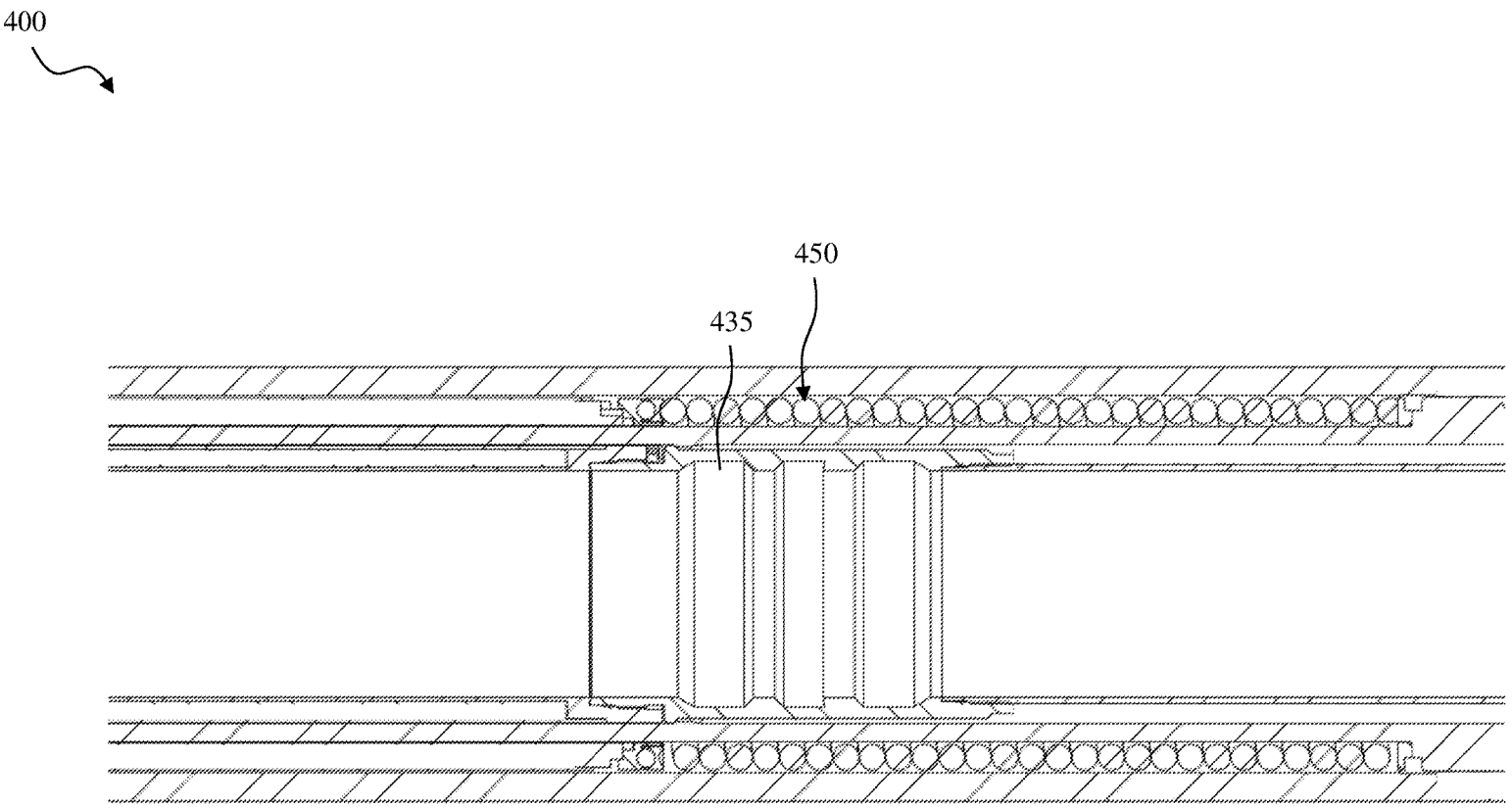

Turning to FIGS. 5A through 5C, illustrated is the safety valve 400 of FIGS. 4A through 4C after the bore flow management actuator 430 has been moved to its downhole state, and thus is propping open the valve body closure mechanism 420. Additionally, a retrievable safety valve insert 500 designed and/or manufactured according to the disclosure has been positioned within the safety valve 400, and particularly within the end sub 460. As discussed above, the retrievable safety valve insert 500 may include an outer housing 210, a lock mandrel 220 having a lock mandrel profile 225, and a safety valve insert safety valve closure mechanism 240. In the illustrated embodiment of FIGS. 5A through 5C, the lock mandrel profile 225 of the retrievable safety valve insert 500 is not yet engaged with the end sub profile 465 of the safety valve 400.

Figure 6A:
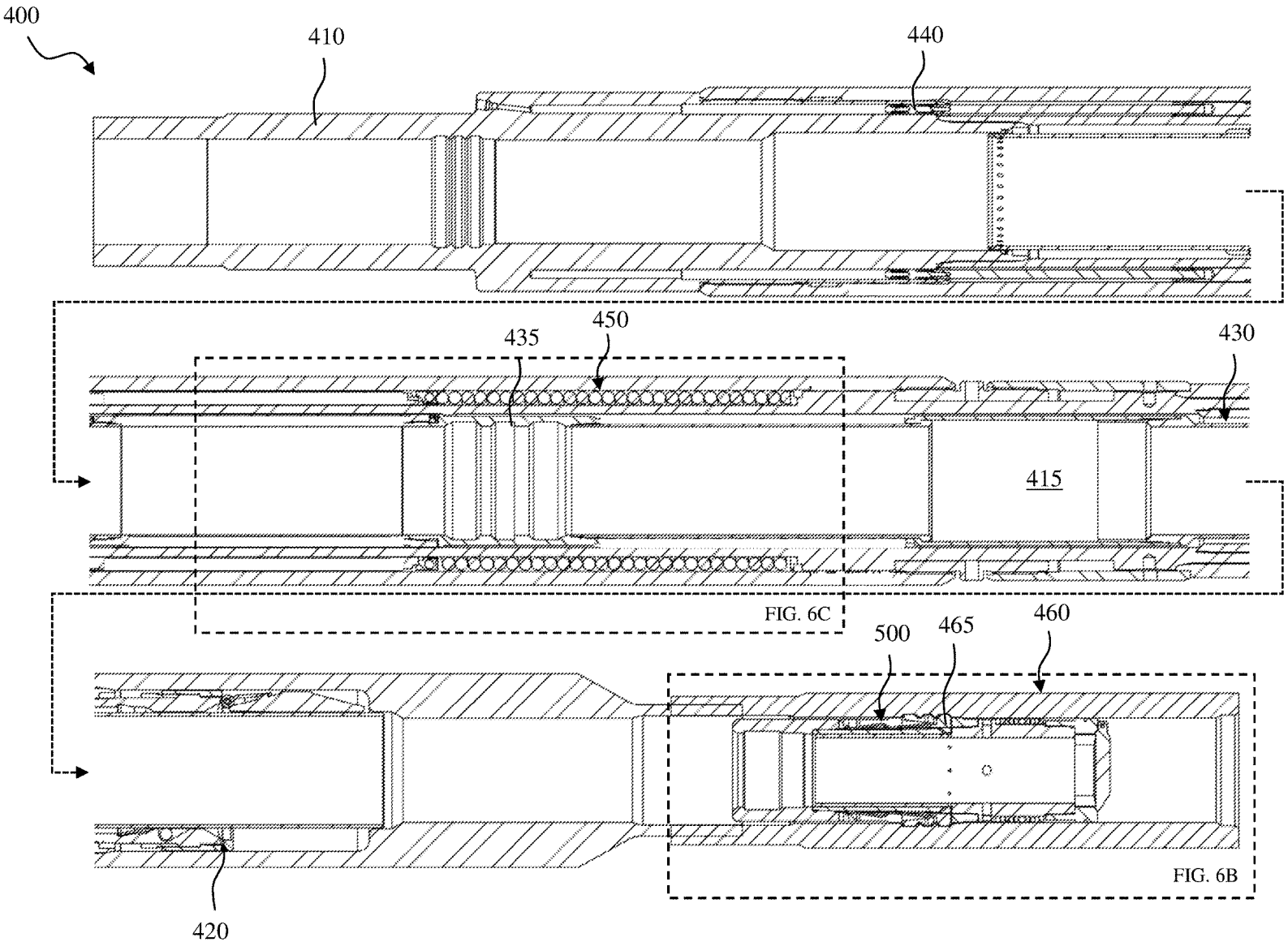
Figure 6B:
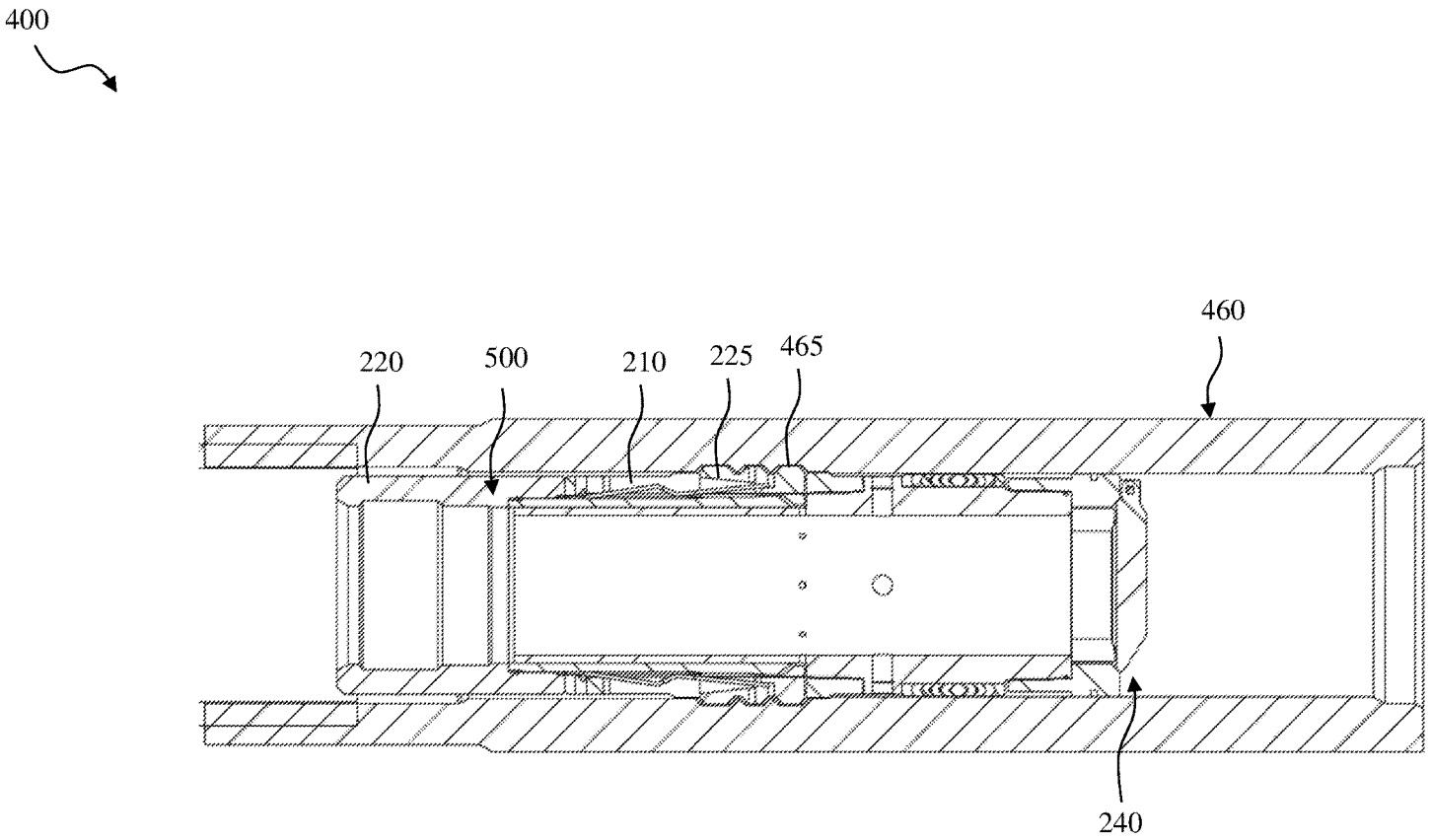
Figure 6C:
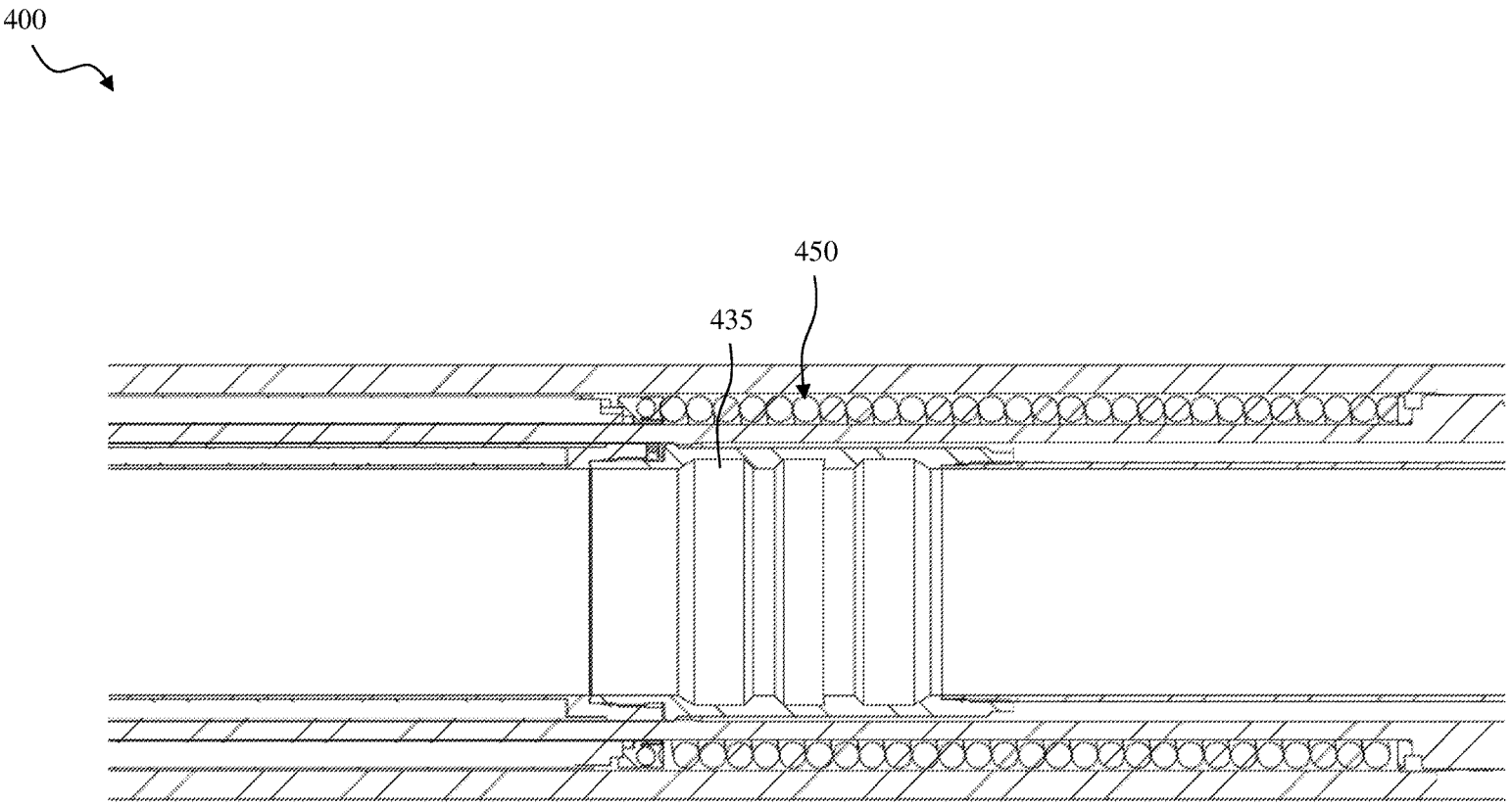

Turning to FIGS. 6A through 6C, illustrated is the safety valve 400 of FIGS. 5A through 5C after the retrievable safety valve insert 500 is coupled to the end sub 460. Specific to the embodiment of FIGS. 6A through 6C, the lock mandrel profile 225 of the lock mandrel 220 is engaged with the end sub profile 465 of the end sub 460.

Figure 7A:
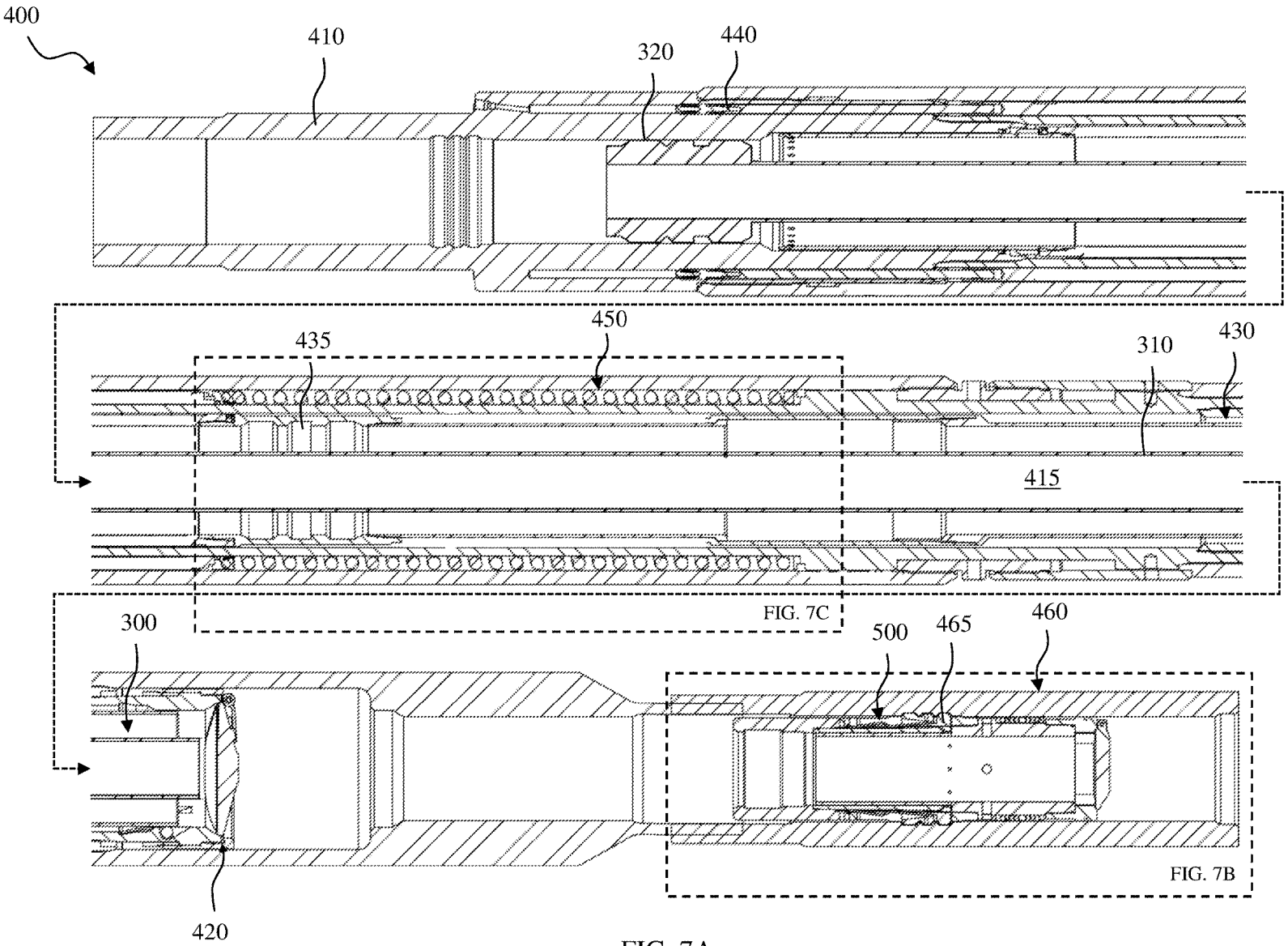
Figure 7B:
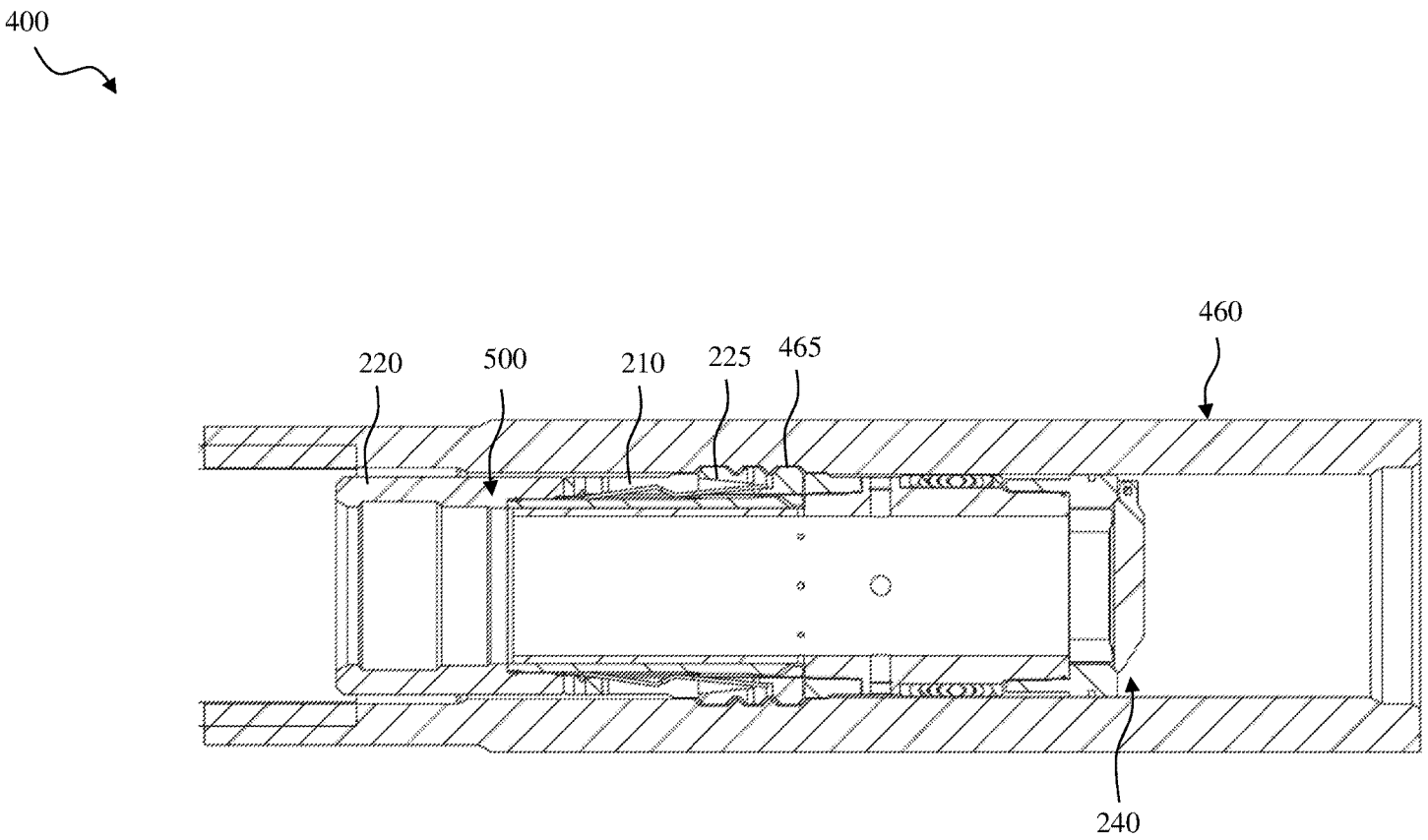
Figure 7C:
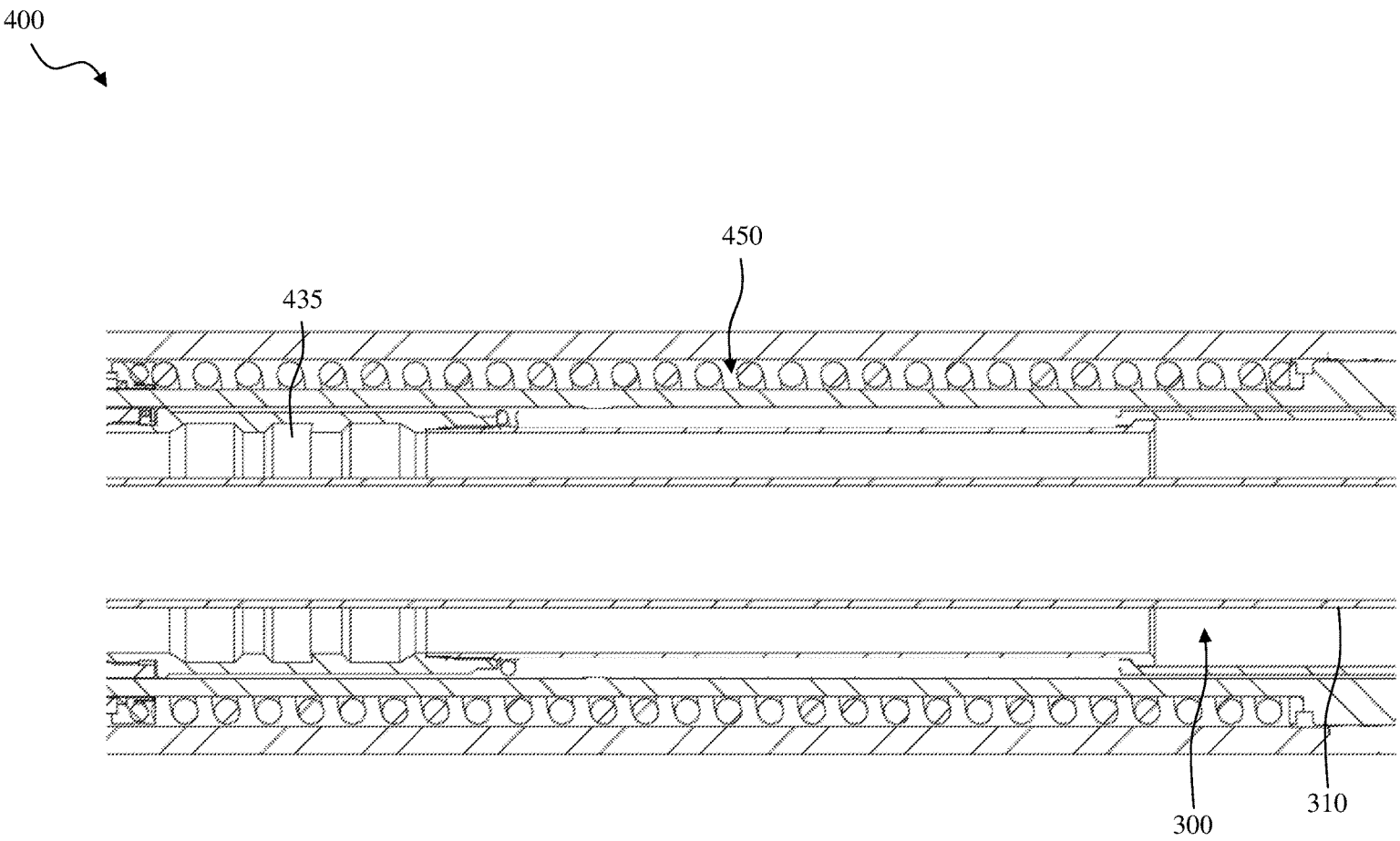

Turning to FIGS. 7A through 7C, illustrated is the safety valve 400 of FIGS. 6A through 6C after positioning a secondary opening prong 300 within the safety valve 400. As discussed above, the secondary opening prong 300 may include a tubular 310 and a secondary opening prong profile 320. In the embodiment of FIGS. 7A through 7C, the tubular 310 has yet to reach the valve body closure mechanism 420.

Figure 8A:
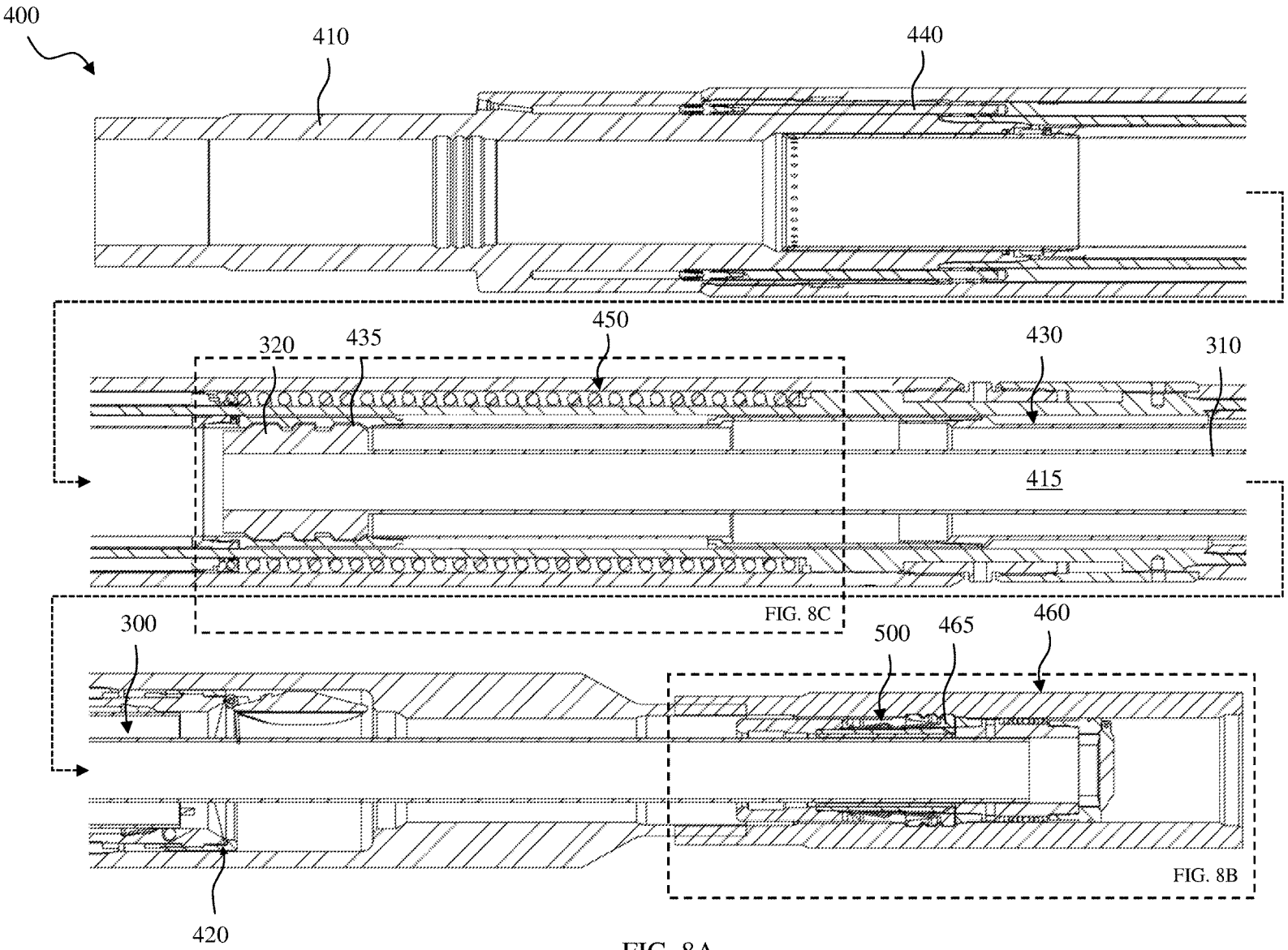
Figure 8B:
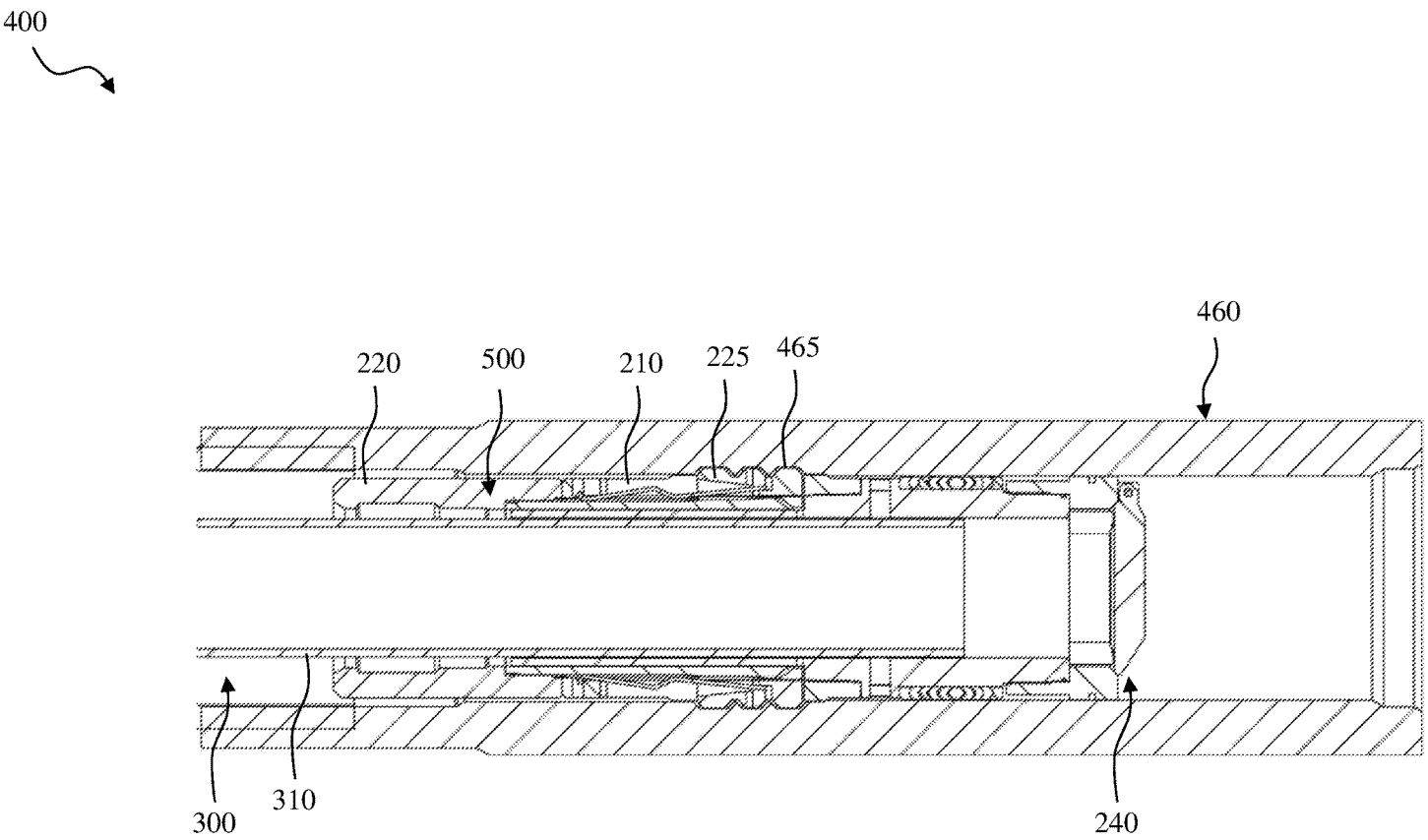
Figure 8C:
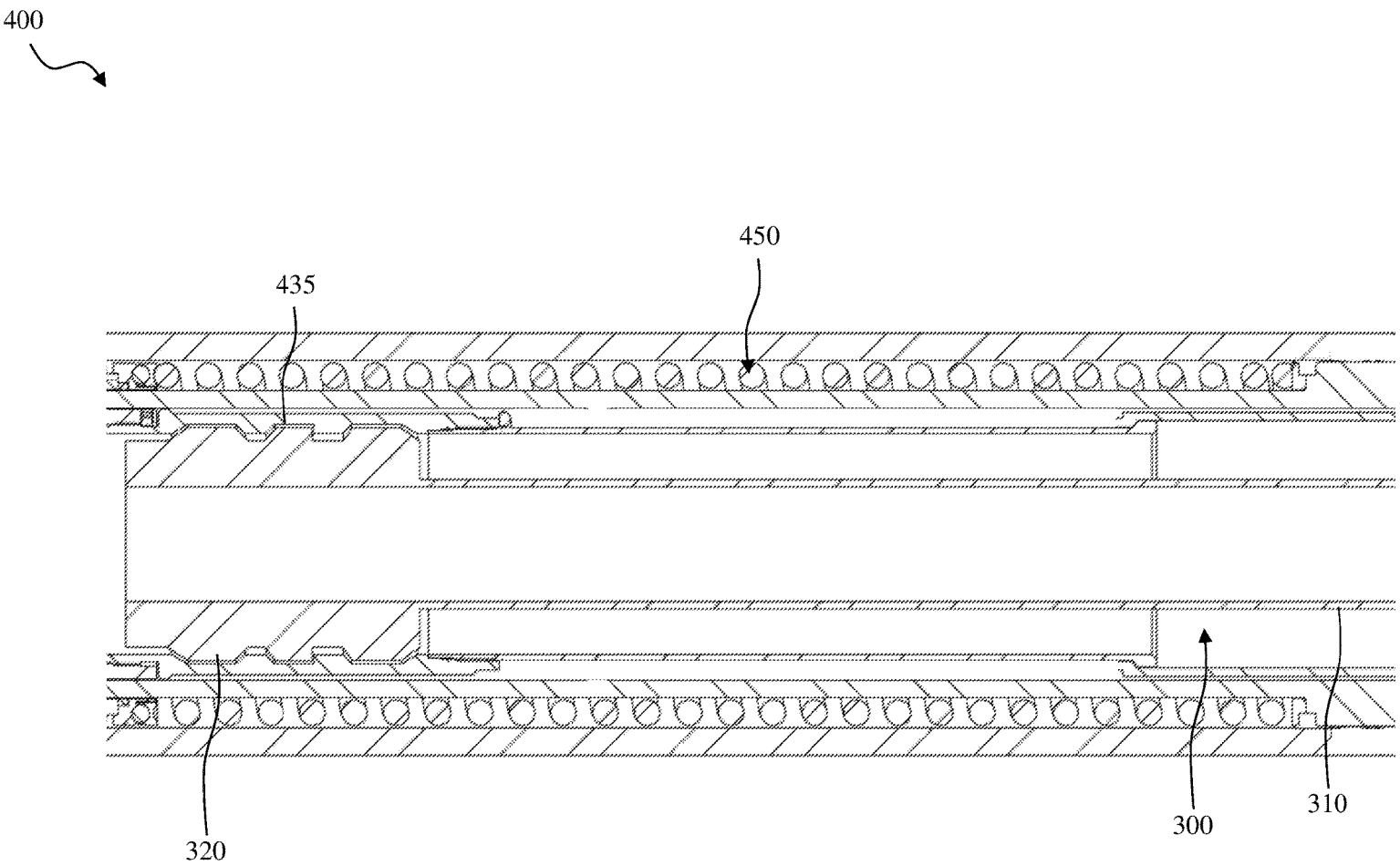

Turning to FIGS. 8A through 8C, illustrated is the safety valve 400 of FIGS. 7A through 7C after coupling the secondary opening prong 300 within the safety valve 400. For example, in the illustrated embodiment of FIGS. 8A through 8C, the secondary opening prong profile 320 is engaged with the bore flow management actuator profile 435, thereby axially fixing the secondary opening prong 300 with the movable bore flow management actuator 430. At this stage, as is shown in this embodiment, the tubular 310 of the secondary opening prong 300 props the valve body closure mechanism 420 in a valve body open state.

Figure 9A:
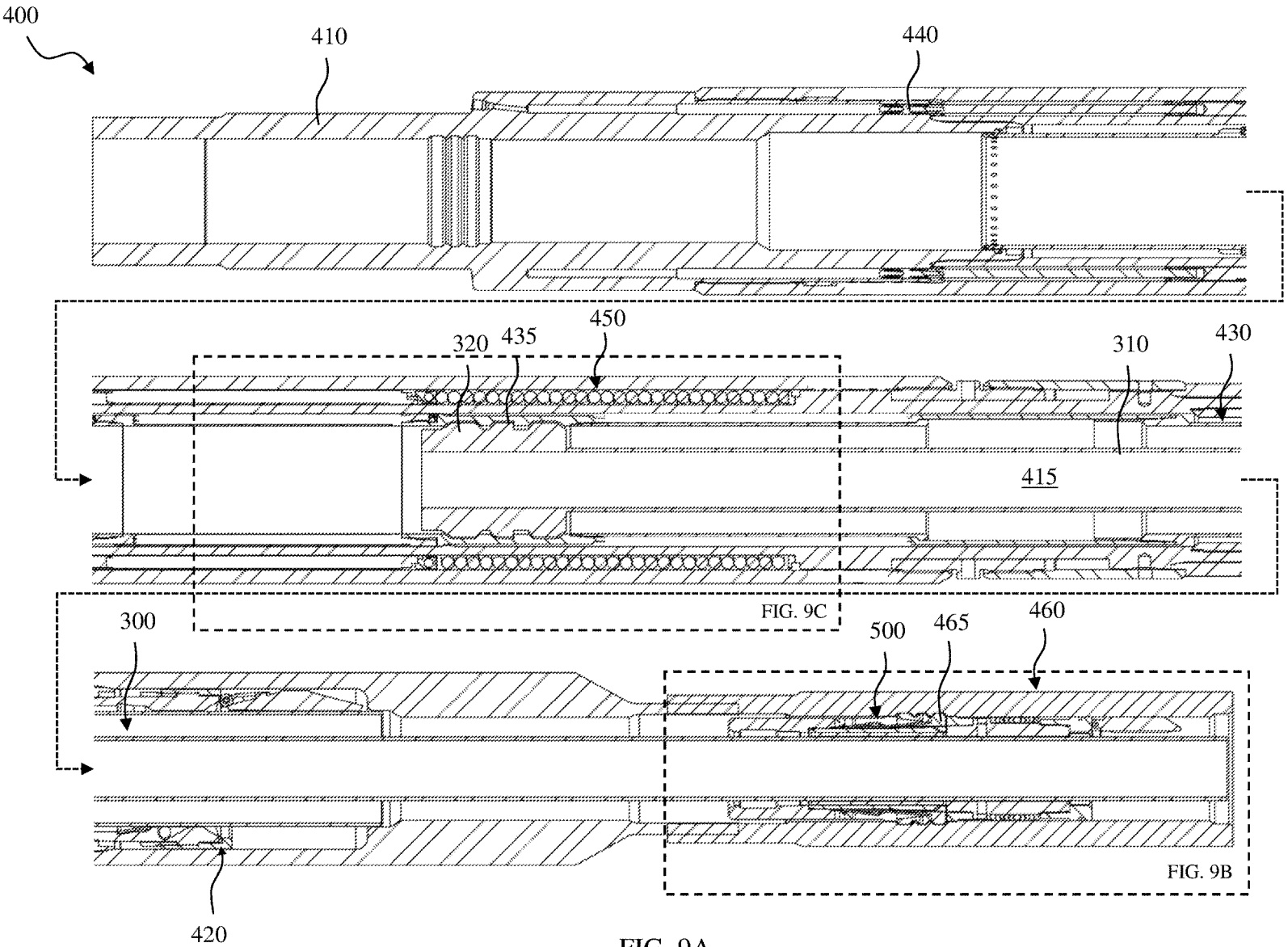
Figure 9B:
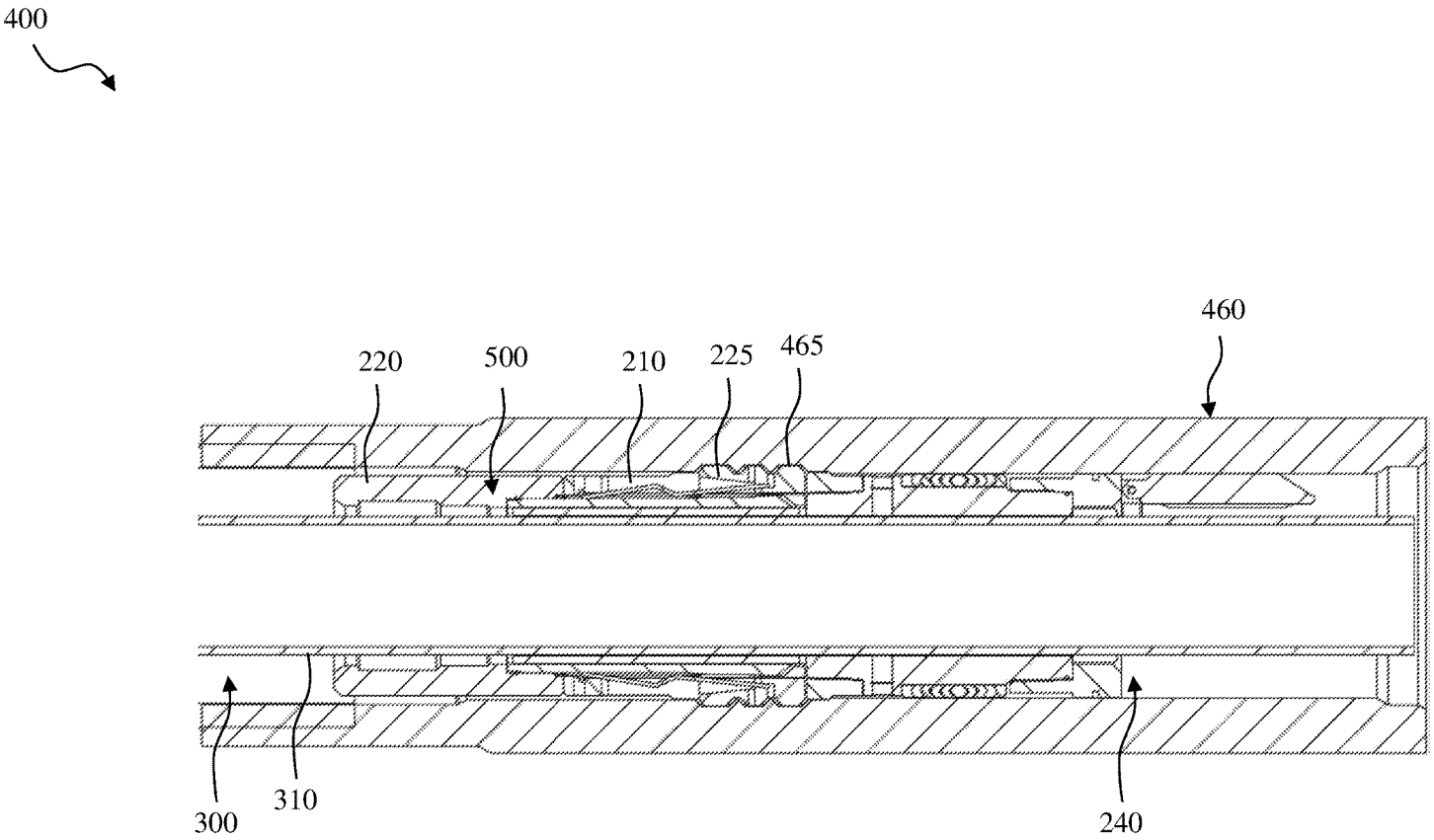
Figure 9C:
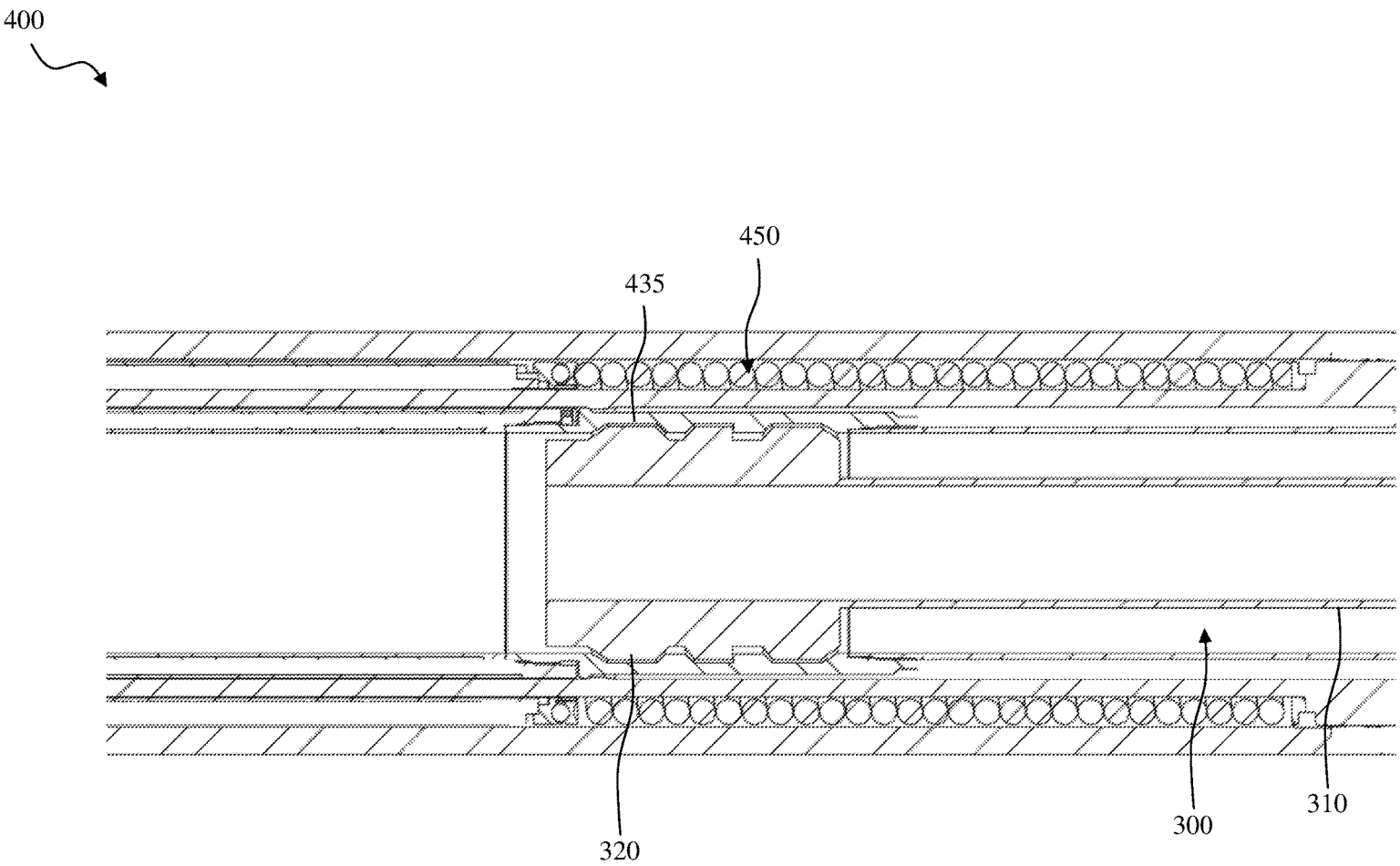

Turning to FIGS. 9A through 9C, illustrated is the safety valve 400 of FIGS. 8A through 8C after actuating the bore flow management actuator 430. As the secondary prong profile 320 is axially fixed to the bore flow management actuator 430, the movement of the bore flow management actuator 430 downhole also moves the secondary prong profile 320 downhole. Additionally, this movement of the secondary prong profile 320 downhole props the safety valve insert closure mechanism 240 from the outer housing closed state of FIGS. 8A through 8C, to the outer housing open state of FIGS. 9A through 9C. At this stage, as is shown in this embodiment, the safety valve 400 is ready for production, and thus is ready to convey the subsurface production fluids there through.

Figure 10A:
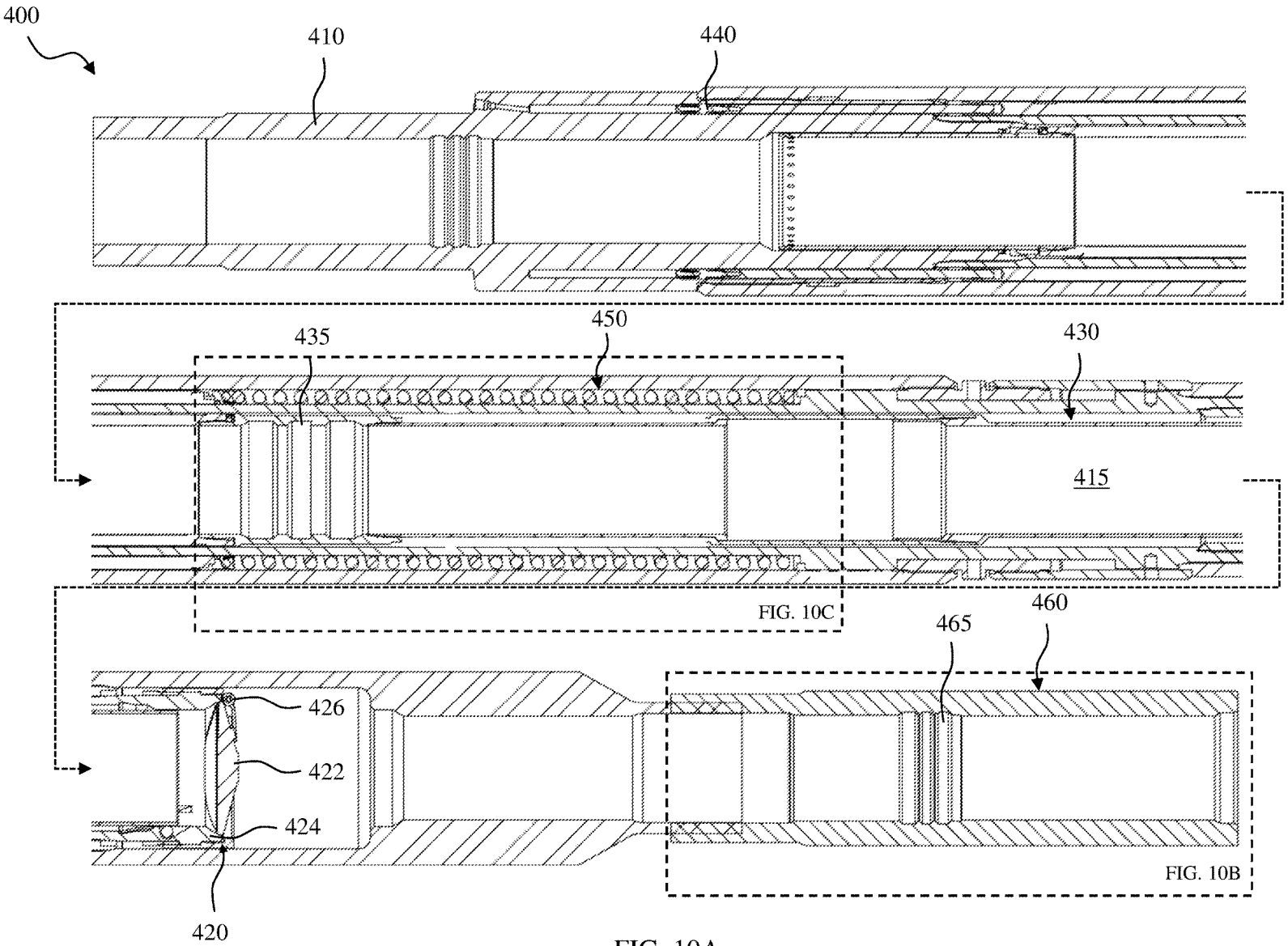
Figure 10B:
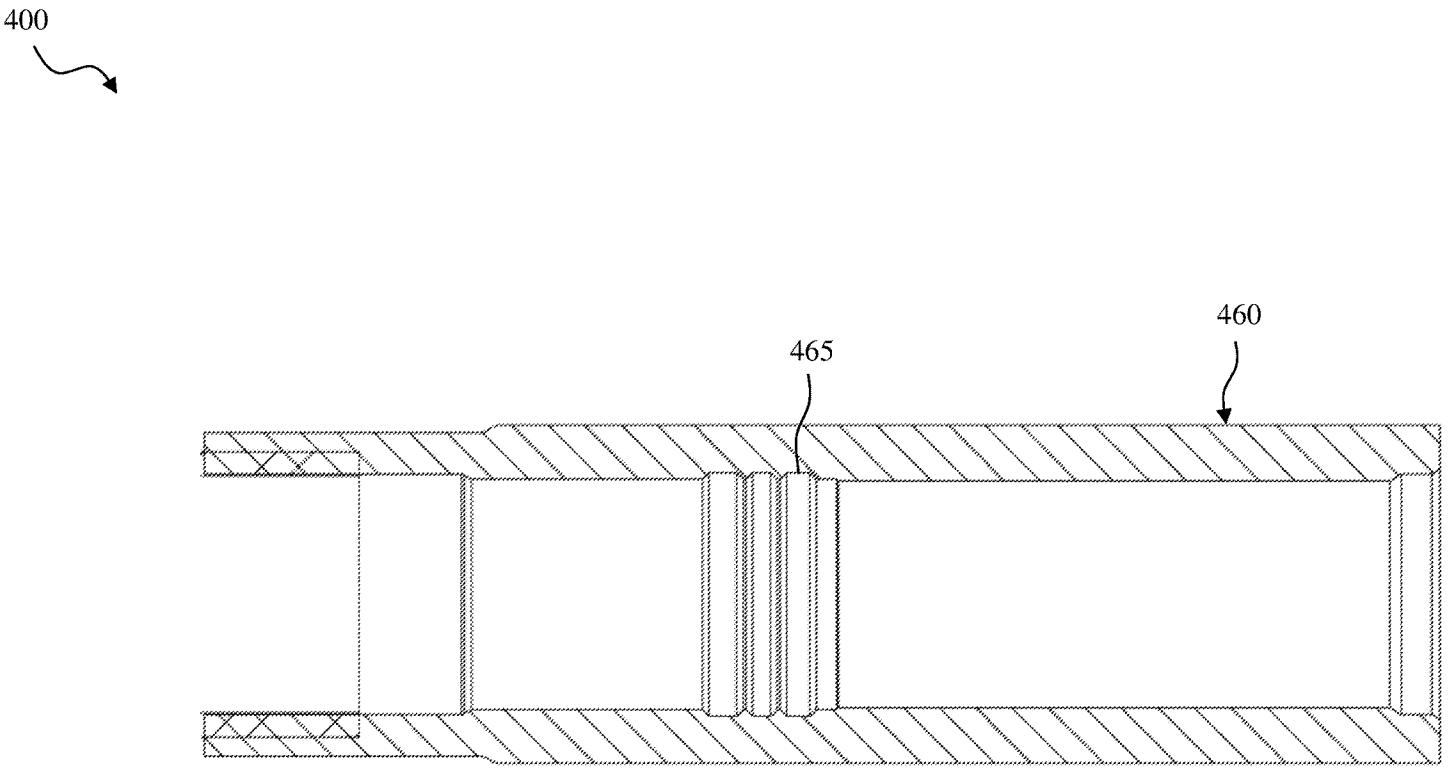
Figure 10C:
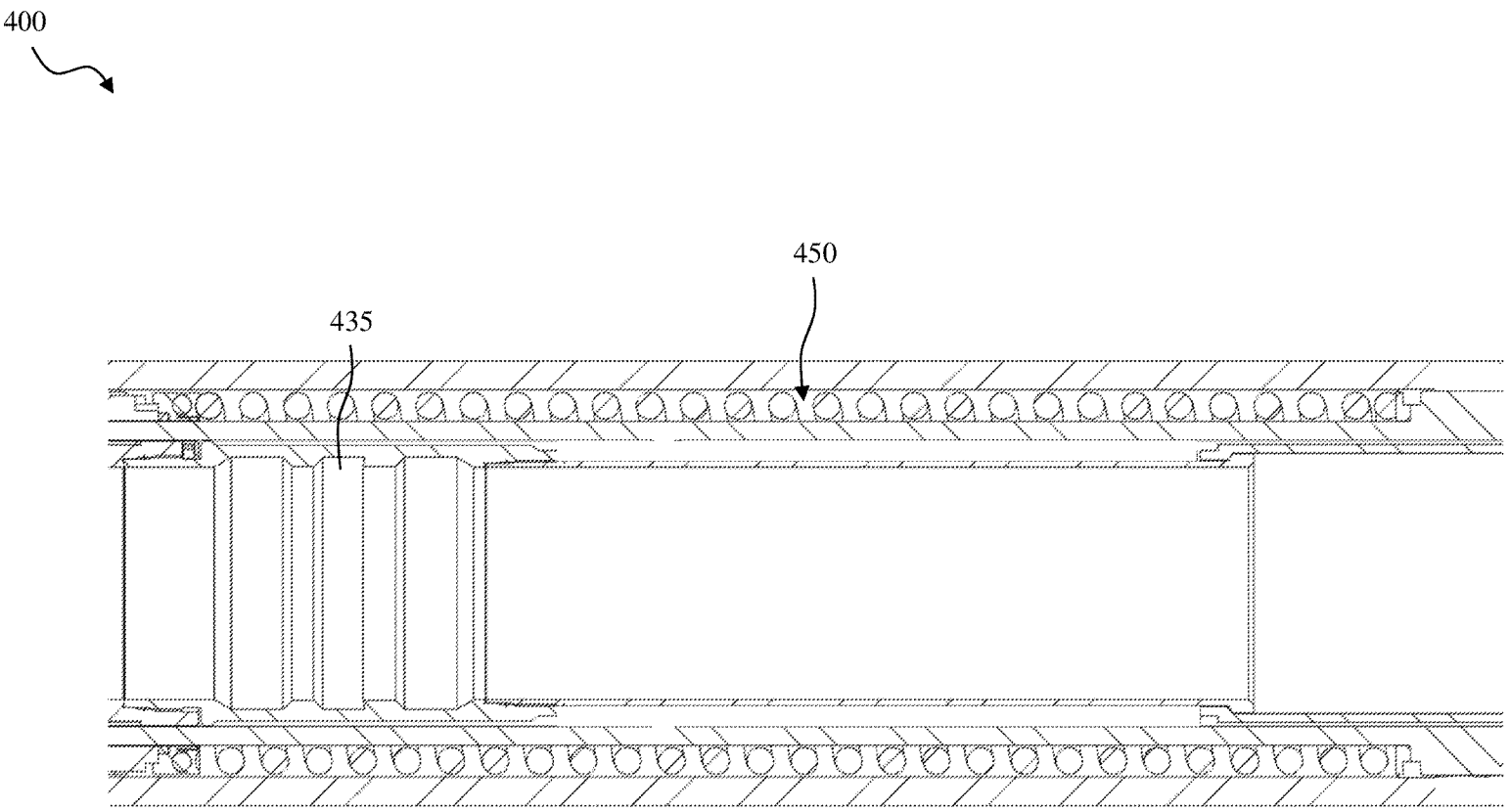

Turning to FIGS. 10A through 10C, illustrated is the safety valve 400 of FIGS. 9A through 9C after removing the retrievable safety valve insert 200 from the safety valve 400. Such an action might occur if the safety valve 400 itself has been repaired, or alternatively if the retrievable safety valve insert 200 has become faulty.

Figure 11A:
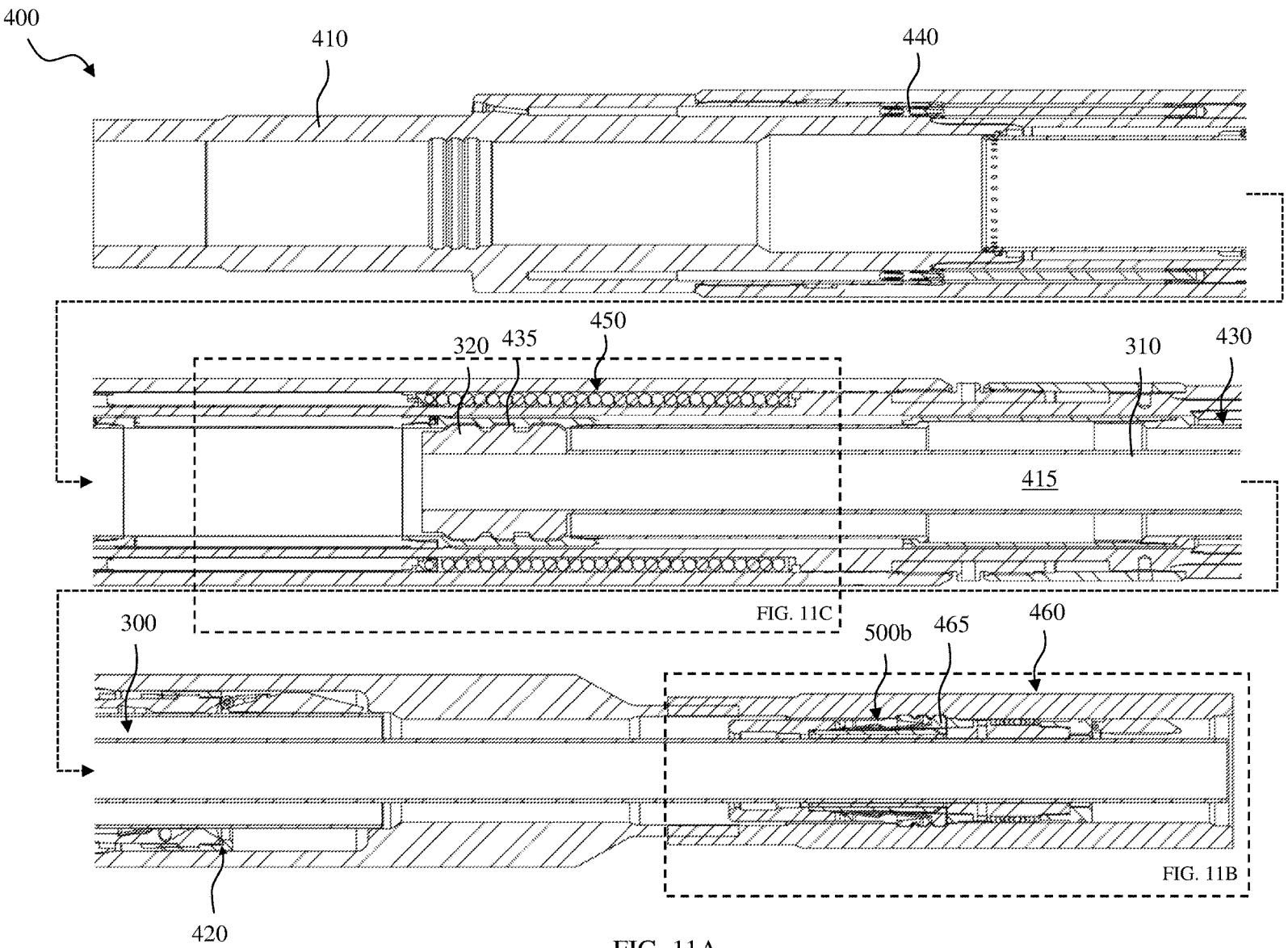
Figure 11B:
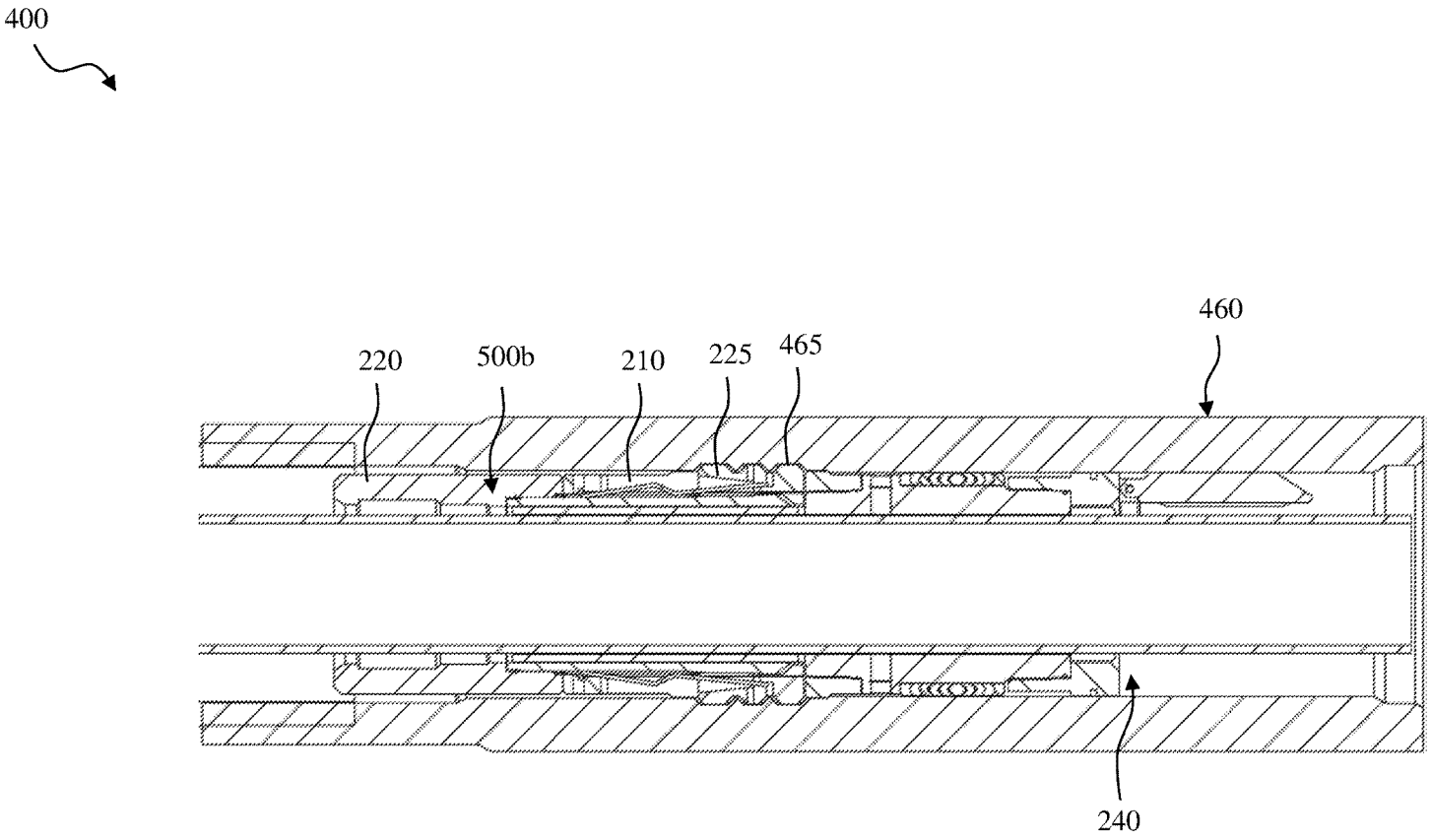
Figure 11C:
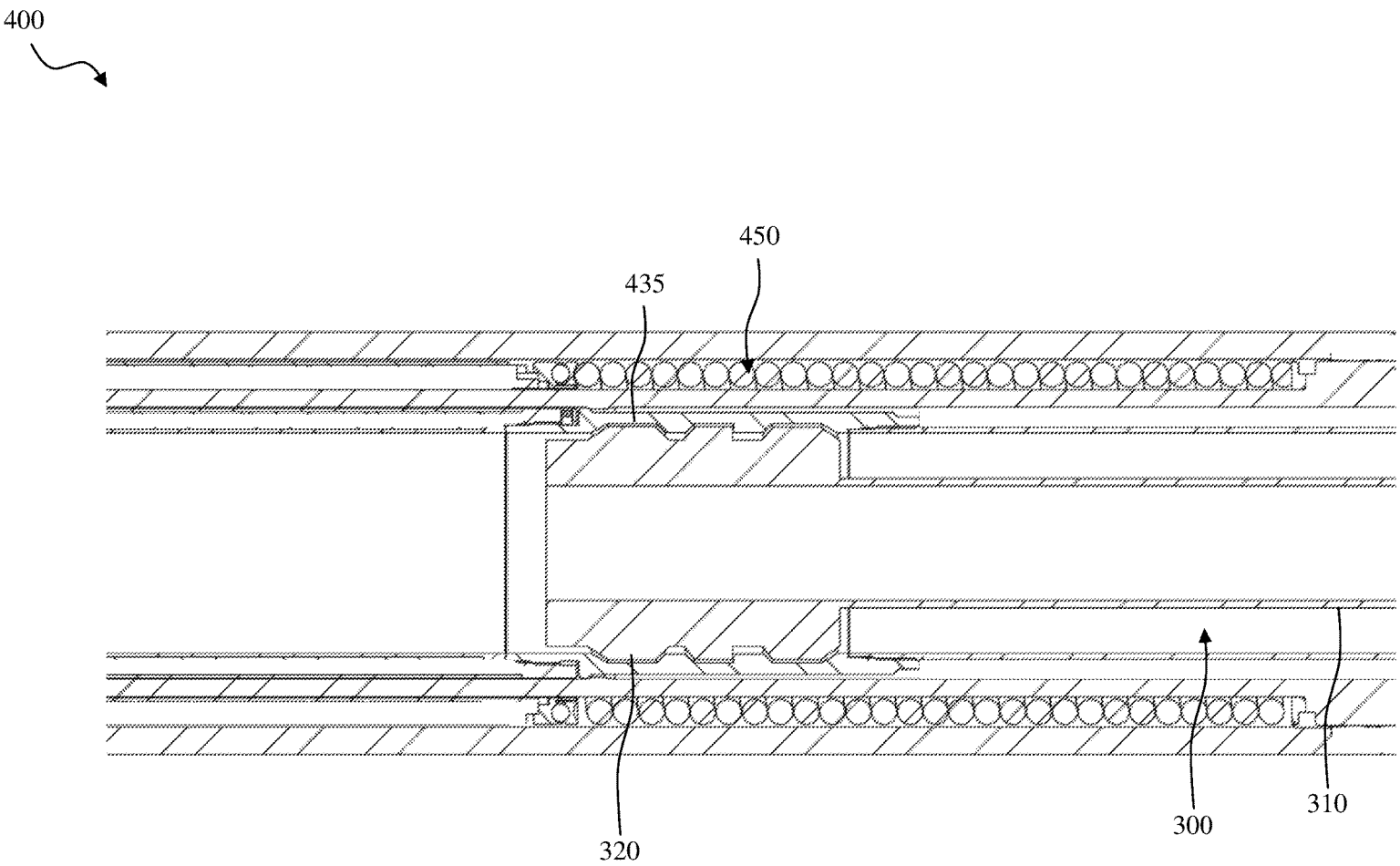

Turning to FIGS. 11A through 11C, illustrated is the safety valve 400 of FIGS. 10A through 10C after inserting a replacement retrievable safety valve insert 500*b* within the wellbore below the valve body closure mechanism 420.

Aspects Disclosed Herein Include:

A. A retrievable safety valve insert, the retrievable safety valve insert including: 1) an outer housing including an outer housing central bore extending axially through the outer housing, the outer housing central bore operable to convey subsurface production fluids there through; 2) a lock mandrel having a lock mandrel profile extending radially outward from the outer housing, the lock mandrel profile movable between a radially retracted state and a radially expanded state configured to engage with an end sub profile of an end sub; and 3) a safety valve insert closure mechanism coupled to the outer housing proximate a downhole end of the outer housing central bore, the safety valve insert closure mechanism movable between an outer housing closed state and an outer housing open state.

B. A safety valve, the safety valve including: 1) a valve body defining a valve body central bore extending through the valve body, the valve body central bore operable to convey subsurface production fluids there through; 2) a valve body closure mechanism coupled to the valve body proximate a downhole end of the valve body central bore; 3) a bore flow management actuator disposed in the valve body central bore, the bore flow management actuator configured to slide to move the valve body closure mechanism between a valve body closed state and a valve body open state; 4) an end sub coupled to a downhole end of the valve body, the end sub including an end sub profile along an inner surface thereof; and 5) a retrievable safety valve insert coupled to the end sub, the retrievable safety valve insert including: a) an outer housing including an outer housing central bore extending axially through the outer housing, the outer housing central bore operable to convey the subsurface production fluids there through; b) a lock mandrel having a lock mandrel profile extending radially outward from the outer housing, the lock mandrel profile movable between a radially retracted state and a radially expanded state engaged with the end sub profile of the end sub; and c) a safety valve insert closure mechanism coupled to the outer housing proximate a downhole end of the outer housing central bore, the safety valve insert closure mechanism movable between an outer housing closed state and an outer housing open state.

C. A well system, the well system including: 1) a wellbore extending through one or more subterranean formations; 2) production tubing disposed in the wellbore; and 3) a safety valve disposed in line with the production tubing, the safety valve including: a) a valve body defining a valve body central bore extending through the valve body, the valve body central bore operable to convey subsurface production fluids there through; b) a valve body closure mechanism coupled to the valve body proximate a downhole end of the valve body central bore; c) a bore flow management actuator disposed in the valve body central bore, the bore flow management actuator configured to slide to move the valve body closure mechanism between a valve body closed state and a valve body open state; d) an end sub coupled to a downhole end of the valve body, the end sub including an end sub profile along an inner surface thereof; and e) a retrievable safety valve insert coupled to the end sub, the retrievable safety valve insert including: i) an outer housing including an outer housing central bore extending axially through the outer housing, the outer housing central bore operable to convey the subsurface production fluids there through; ii) a lock mandrel having a lock mandrel profile extending radially outward from the outer housing, the lock mandrel profile movable between a radially retracted state and a radially expanded state engaged with the end sub profile of the end sub; and iii) a safety valve insert closure mechanism coupled to the outer housing proximate a downhole end of the outer housing central bore, the safety valve insert closure mechanism movable between an outer housing closed state and an outer housing open state.

D. A method for assembling and operating a safety valve, the method including: 1) positioning a safety valve within a wellbore extending through one or more subterranean formations, the safety valve disposed in line with production tubing located within the wellbore, the safety valve including: a) a valve body defining a valve body central bore extending through the valve body, the valve body central bore operable to convey subsurface production fluids there through; b) a valve body closure mechanism coupled to the valve body proximate a downhole end of the valve body central bore; c) a bore flow management actuator disposed in the valve body central bore, the bore flow management actuator configured to slide to move the valve body closure mechanism between a valve body closed state and a valve body open state; and d) an end sub coupled to a downhole end of the valve body, the end sub including an end sub profile along an inner surface thereof; 2) actuating the bore flow management actuator to slide the valve body closure mechanism from the valve body closed state to the valve body open state; and 3) positioning a retrievable safety valve insert within the wellbore below the valve body closure mechanism after actuating the bore flow management actuator, the retrievable safety valve insert including: a) an outer housing including an outer housing central bore extending axially through the outer housing, the outer housing central bore operable to convey the subsurface production fluids there through; b) a lock mandrel having a lock mandrel profile extending radially outward from the outer housing, the lock mandrel profile movable between a radially retracted state and a radially expanded state engaged with the end sub profile of the end sub; and c) a safety valve insert closure mechanism coupled to the outer housing proximate a downhole end of the outer housing central bore, the safety valve insert closure mechanism movable between an outer housing closed state and an outer housing open state.

Aspects A, B, C and D may have one or more of the following additional elements in combination: Element 1: wherein the safety valve insert closure mechanism is a flapper valve configured to engage with a safety valve insert flapper seat positioned in the outer housing. Element 2: further including one or more seals positioned about the outer housing between the lock mandrel profile and the safety valve insert closure mechanism. Element 3: further including a deployment profile located along an inner surface of the lock mandrel, the deployment profile operable to deploy the retrievable safety valve insert within the end sub, as well as move the lock mandrel profile from the radially retracted state to the radially expanded state to engage the end sub profile of the end sub. Element 4: wherein the bore flow management actuator has a bore flow management actuator profile located along an inner surface thereof, and further including a secondary opening prong including a secondary opening prong profile located within the valve body central bore, the secondary opening prong profile coupled with the bore flow management actuator profile. Element 5: wherein the secondary opening prong is configured to move with the bore flow management actuator to: hold the valve body closure mechanism in the valve body open state and allow the safety valve insert closure mechanism to remain in the outer housing closed state when the bore flow management actuator is in an uphole state; or hold the valve body closure mechanism in the valve body open state and hold the safety valve insert closure mechanism in the outer housing open state when the bore flow management actuator is in a downhole state. Element 6: wherein a hydraulic actuator is coupled to the bore flow management actuator to move the bore flow management actuator from the valve body closed state and the valve body open state. Element 7: wherein an electric actuator is coupled to the bore flow management actuator to move the bore flow management actuator from the valve body closed state and the valve body open state. Element 8: further including one or more springs coupled to the bore flow management actuator, the one or more springs configured to return the bore flow management actuator to the valve body closed state when an actuator coupled to the bore flow management actuator loses power. Element 9: wherein the safety valve insert closure mechanism is a flapper valve configured to engage with a safety valve insert flapper seat positioned in the outer housing. Element 10: further including one or more seals positioned about the outer housing between the lock mandrel profile and the safety valve insert closure mechanism. Element 11: further including a deployment profile located along an inner surface of the lock mandrel, the deployment profile operable to deploy the retrievable safety valve insert within the end sub, as well as move the lock mandrel profile from the radially retracted state to the radially expanded state to engage the end sub profile of the end sub. Element 12: wherein positioning the retrievable safety valve insert includes coupling the lock mandrel profile with the end sub profile of the end sub. Element 13: further including coupling a secondary opening prong with the bore flow management actuator after positioning the retrievable safety valve insert within the wellbore. Element 14: wherein the bore flow management actuator has a bore flow management actuator profile located along an inner surface thereof and the secondary opening prong includes a secondary opening prong profile located along an outer surface thereof, and further wherein coupling the secondary opening prong with the bore flow management actuator includes coupling the secondary opening prong profile with the bore flow management actuator profile. Element 15: wherein coupling the secondary opening prong with the bore flow management actuator occurs after allowing the bore flow management actuator to return to the valve body closed state. Element 16: wherein the secondary opening prong is configured to move with the bore flow management actuator to: hold the valve body closure mechanism in the valve body open state and allow the safety valve insert closure mechanism to remain in the outer housing closed state when the bore flow management actuator is in an uphole state; or hold the valve body closure mechanism in the valve body open state and hold the safety valve insert closure mechanism in the outer housing open state when the bore flow management actuator is in a downhole state. Element 17: further including re-actuating the bore flow management actuator after coupling the secondary opening prong with the bore flow management actuator, the secondary opening prong moving to a downhole state to hold the valve body closure mechanism in the valve body open state and hold the safety valve insert closure mechanism in the outer housing open state. Element 18: wherein the retrievable safety valve insert is a first retrievable safety valve insert, and further including removing the first retrievable safety valve insert from the wellbore and then positioning a second retrievable safety valve insert within the wellbore below the valve body closure mechanism.

Those skilled in the art to which this application relates will appreciate that other and further additions, deletions, substitutions and modifications may be made to the described embodiments.

What is claimed is:

1. A retrievable safety valve insert, comprising:

an outer housing including an outer housing central bore extending axially through the outer housing, the outer housing central bore operable to convey subsurface production fluids there through;

a lock mandrel having a lock mandrel profile extending radially outward from the outer housing, the lock mandrel including a sliding wedge, the lock mandrel profile movable between a radially retracted state and a radially expanded state configured to engage with an end sub profile of an end sub as the sliding wedge slides to engage the lock mandrel profile; and a safety valve insert closure mechanism coupled to the outer housing proximate a downhole end of the outer housing central bore, the safety valve insert closure mechanism movable between an outer housing closed state preventing the subsurface production fluids from flowing there through and an outer housing open state allowing the subsurface production fluids to flow there through.

2. The retrievable safety valve insert as recited in claim 1, wherein the safety valve insert closure mechanism is a flapper valve configured to engage with a safety valve insert flapper seat positioned in the outer housing.

3. The retrievable safety valve insert as recited in claim 1, further including one or more seals positioned about the outer housing between the lock mandrel profile and the safety valve insert closure mechanism.

4. The retrievable safety valve insert as recited in claim 1, further including a deployment profile located along an inner surface of the lock mandrel, the deployment profile operable to deploy the retrievable safety valve insert within the end sub, as well as move the lock mandrel profile from the radially retracted state to the radially expanded state to engage the end sub profile of the end sub.

5. A safety valve, comprising:

a valve body defining a valve body central bore extending through the valve body, the valve body central bore operable to convey subsurface production fluids there through;

a valve body closure mechanism coupled to the valve body proximate a downhole end of the valve body central bore, the valve body closure mechanism movable between a valve housing closed state preventing the subsurface production fluids from flowing there through and a valve housing open state allowing the subsurface production fluids to flow there through;

a bore flow management actuator disposed in the valve body central bore, the bore flow management actuator configured to slide to move the valve body closure mechanism between a valve body closed state and a valve body open state;

an end sub coupled to a downhole end of the valve body, the end sub including an end sub profile along an inner surface thereof; and a retrievable safety valve insert coupled to the end sub profile of the end sub, the retrievable safety valve insert including:

an outer housing including an outer housing central bore extending axially through the outer housing, the outer housing central bore operable to convey the subsurface production fluids there through;

a lock mandrel having a lock mandrel profile extending radially outward from the outer housing, the lock mandrel including a sliding wedge, the lock mandrel profile movable between a radially retracted state and a radially expanded state engaged with the end sub profile of the end sub as the sliding wedge slides to engage the lock mandrel profile; and a safety valve insert closure mechanism coupled to the outer housing proximate a downhole end of the outer housing central bore, the safety valve insert closure mechanism movable between an outer housing closed state preventing the subsurface production fluids from flowing there through and an outer housing open state allowing the subsurface production fluids to flow there through.

6. The safety valve as recited in claim 5, wherein the bore flow management actuator has a bore flow management actuator profile located along an inner surface thereof, and further including a secondary opening prong including a secondary opening prong profile located within the valve body central bore, the secondary opening prong profile coupled with the bore flow management actuator profile.

7. The safety valve as recited in claim 6, wherein the secondary opening prong is configured to move with the bore flow management actuator to:

hold the valve body closure mechanism in the valve body open state and allow the safety valve insert closure mechanism to remain in the outer housing closed state when the bore flow management actuator is in an uphole state; or hold the valve body closure mechanism in the valve body open state and hold the safety valve insert closure mechanism in the outer housing open state when the bore flow management actuator is in a downhole state.

8. The safety valve as recited in claim 5, wherein a hydraulic actuator is coupled to the bore flow management actuator to move the bore flow management actuator from the valve body closed state and the valve body open state.

9. The safety valve as recited in claim 5, wherein an electric actuator is coupled to the bore flow management actuator to move the bore flow management actuator from the valve body closed state and the valve body open state.

10. The safety valve as recited in claim 5, further including one or more springs coupled to the bore flow management actuator, the one or more springs configured to return the bore flow management actuator to the valve body closed state when an actuator coupled to the bore flow management actuator loses power.

11. The safety valve as recited in claim 5, wherein the safety valve insert closure mechanism is a safety valve insert flapper valve configured to engage with a safety valve insert flapper seat positioned in the outer housing.

12. The safety valve as recited in claim 11, wherein the valve body closure mechanism is valve body closure mechanism flapper valve.

13. The safety valve as recited in claim 5, further including one or more seals positioned about the outer housing between the lock mandrel profile and the safety valve insert closure mechanism.

14. The safety valve as recited in claim 5, further including a deployment profile located along an inner surface of the lock mandrel, the deployment profile operable to deploy the retrievable safety valve insert within the end sub, as well as move the lock mandrel profile from the radially retracted state to the radially expanded state to engage the end sub profile of the end sub.

15. A well system, comprising:

a wellbore extending through one or more subterranean formations;

production tubing disposed in the wellbore; and a safety valve disposed in line with the production tubing, the safety valve including:

a valve body defining a valve body central bore extending through the valve body, the valve body central bore operable to convey subsurface production fluids there through;

a valve body closure mechanism coupled to the valve body proximate a downhole end of the valve body central bore, the valve body closure mechanism movable between a valve housing closed state preventing the subsurface production fluids from flowing there through and a valve housing open state allowing the subsurface production fluids to flow there through;

a bore flow management actuator disposed in the valve body central bore, the bore flow management actuator configured to slide to move the valve body closure mechanism between a valve body closed state and a valve body open state;

an end sub coupled to a downhole end of the valve body, the end sub including an end sub profile along an inner surface thereof; and a retrievable safety valve insert coupled to the end sub profile of the end sub, the retrievable safety valve insert including:

an outer housing including an outer housing central bore extending axially through the outer housing, the outer housing central bore operable to convey the subsurface production fluids there through;

a lock mandrel having a lock mandrel profile extending radially outward from the outer housing, the lock mandrel including a sliding wedge, the lock mandrel profile movable between a radially retracted state and a radially expanded state engaged with the end sub profile of the end sub as the sliding wedge slides to engage the lock mandrel profile; and a safety valve insert closure mechanism coupled to the outer housing proximate a downhole end of the outer housing central bore, the safety valve insert closure mechanism movable between an outer housing closed state preventing the subsurface production fluids from flowing there through and an outer housing open state allowing the subsurface production fluids to flow there through.

16. The well system as recited in claim 15, wherein the bore flow management actuator has a bore flow management actuator profile located along an inner surface thereof, and further including a secondary opening prong including a secondary opening prong profile located within the valve body central bore, the secondary opening prong profile coupled with the bore flow management actuator profile.

17. The well system as recited in claim 16, wherein the secondary opening prong is configured to move with the bore flow management actuator to:

hold the valve body closure mechanism in the valve body open state and allow the safety valve insert closure mechanism to remain in the outer housing closed state when the bore flow management actuator is in an uphole state; or hold the valve body closure mechanism in the valve body open state and hold the safety valve insert closure mechanism in the outer housing open state when the bore flow management actuator is in a downhole state.

18. The well system as recited in claim 15, wherein the safety valve insert closure mechanism is a safety valve insert flapper valve configured to engage with a safety valve insert flapper seat positioned in the outer housing.

19. The well system as recited in claim 18, wherein the valve body closure mechanism is valve body closure mechanism flapper valve.

20. The well system as recited in claim 15, further including one or more seals positioned about the outer housing between the lock mandrel profile and the safety valve insert closure mechanism.

21. The well system as recited in claim 15, further including a deployment profile located along an inner surface of the lock mandrel, the deployment profile operable to deploy the retrievable safety valve insert within the end sub, as well as move the lock mandrel profile from the radially retracted state to the radially expanded state to engage the end sub profile of the end sub.

22. A method for assembling and operating a safety valve, comprising:

positioning a safety valve within a wellbore extending through one or more subterranean formations, the safety valve disposed inline with production tubing located within the wellbore, the safety valve including:

a valve body defining a valve body central bore extending through the valve body, the valve body central bore operable to convey subsurface production fluids there through;

a valve body closure mechanism coupled to the valve body proximate a downhole end of the valve body central bore, the valve body closure mechanism movable between a valve housing closed state preventing the subsurface production fluids from flowing there through and a valve housing open state allowing the subsurface production fluids to flow there through;

a bore flow management actuator disposed in the valve body central bore, the bore flow management actuator configured to slide to move the valve body closure mechanism between a valve body closed state and a valve body open state; and an end sub coupled to a downhole end of the valve body, the end sub including an end sub profile along an inner surface thereof;

actuating the bore flow management actuator to slide the valve body closure mechanism from the valve body closed state to the valve body open state; and positioning a retrievable safety valve insert within the wellbore below the valve body closure mechanism after actuating the bore flow management actuator, the retrievable safety valve insert coupled to the end sub profile of the end sub, the retrievable safety valve insert including:

an outer housing including an outer housing central bore extending axially through the outer housing, the outer housing central bore operable to convey the subsurface production fluids there through;

a lock mandrel having a lock mandrel profile extending radially outward from the outer housing, the lock mandrel including a sliding wedge, the lock mandrel profile movable between a radially retracted state and a radially expanded state engaged with the end sub profile of the end sub as the sliding wedge slides to engage the lock mandrel profile; and a safety valve insert closure mechanism coupled to the outer housing proximate a downhole end of the outer housing central bore, the safety valve insert closure mechanism movable between an outer housing closed state preventing the subsurface production fluids from flowing there through and an outer housing open state allowing the subsurface production fluids to flow there through.

23. The method as recited in claim 22, wherein positioning the retrievable safety valve insert includes coupling the lock mandrel profile with the end sub profile of the end sub.

24. The method as recited in claim 23, further including coupling a secondary opening prong with the bore flow management actuator after positioning the retrievable safety valve insert within the wellbore.

25. The method as recited in claim 24, wherein the bore flow management actuator has a bore flow management actuator profile located along an inner surface thereof and the secondary opening prong includes a secondary opening prong profile located along an outer surface thereof, and further wherein coupling the secondary opening prong with the bore flow management actuator includes coupling the secondary opening prong profile with the bore flow management actuator profile.

26. The method as recited in claim 24, wherein coupling the secondary opening prong with the bore flow management actuator occurs after allowing the bore flow management actuator to return to the valve body closed state.

27. The method as recited in claim 26, wherein the secondary opening prong is configured to move with the bore flow management actuator to:

hold the valve body closure mechanism in the valve body open state and allow the safety valve insert closure mechanism to remain in the outer housing closed state when the bore flow management actuator is in an uphole state; or hold the valve body closure mechanism in the valve body open state and hold the safety valve insert closure mechanism in the outer housing open state when the bore flow management actuator is in a downhole state.

28. The method as recited in claim 26, further including re-actuating the bore flow management actuator after coupling the secondary opening prong with the bore flow management actuator, the secondary opening prong moving to a downhole state to hold the valve body closure mechanism in the valve body open state and hold the safety valve insert closure mechanism in the outer housing open state.

29. The method as recited in claim 28, wherein the retrievable safety valve insert is a first retrievable safety valve insert, and further including removing the first retrievable safety valve insert from the wellbore and then positioning a second retrievable safety valve insert within the wellbore below the valve body closure mechanism.

30. The method as recited in claim 22, wherein the safety valve insert closure mechanism is a safety valve insert flapper valve and the valve body closure mechanism is valve body closure mechanism flapper valve.

* * * * *